United States Patent [19]

Banks et al.

[11] 4,058,275

[45] Nov. 15, 1977

[54] LOW FREQUENCY PASSIVE GUIDANCE METHOD

[75] Inventors: Clarence K. Banks, San Diego, Calif.; Prescott D. Crout, Lexington, Mass.; Paul B. Homer, China Lake, Calif.

[73] Assignee: The United States of America as represented by the Secretary of the Navy, Washington, D.C.

[21] Appl. No.: 102,248

[22] Filed: Dec. 28, 1970

[51] Int. Cl.[2] ..... F41G 9/00; F41G 11/00; G01R 33/02; G01R 33/00

[52] U.S. Cl. ..... 244/3.15; 324/244

[58] Field of Search ..... 340/24; 244/114.5, 3.15; 343/105, 107; 89/1.5

[56] References Cited

U.S. PATENT DOCUMENTS

| | | | |
|---|---|---|---|
| 2,483,417 | 10/1949 | Johnson | 89/1.5 |
| 2,956,278 | 10/1960 | Branchu | 343/107 |

*Primary Examiner*—Samuel W. Engle
*Assistant Examiner*—Thomas H. Webb
*Attorney, Agent, or Firm*—R. S. Sciascia; Roy Miller

[57] ABSTRACT

A system for detecting the low frequency electromagnetic field radiated by electrical and electronic equipment comprising field coils oriented perpendicularly to a missile axis.

4 Claims, 17 Drawing Figures

*INVENTORS*
CLARENCE K. BANKS
PRESCOTT D. CROUT
PAUL B. HOMER

*BY* ROY MILLER
ATTORNEY.

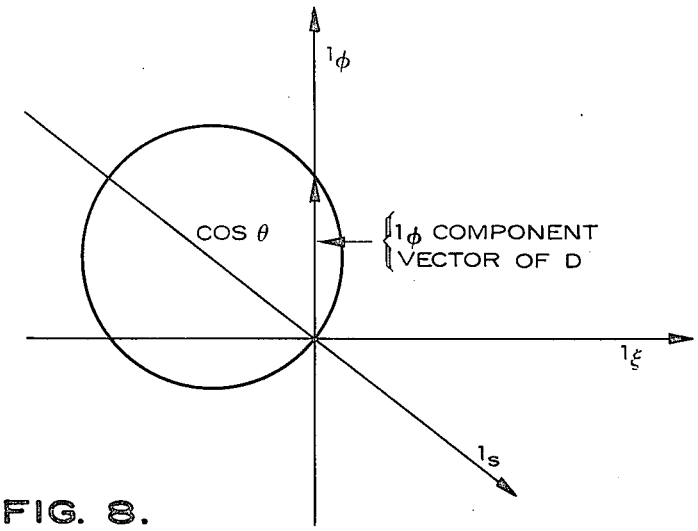
FIG. 8.
FIG. 9.
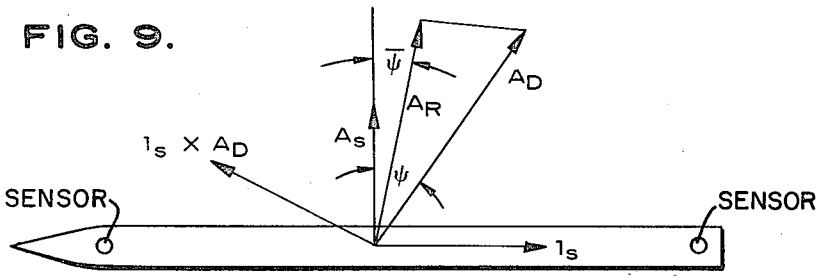
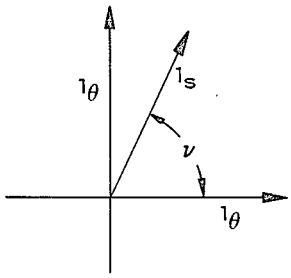
FIG. 10a.
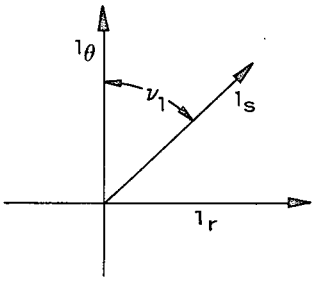
FIG. 10b.

VIEW IN -1 DIRECTION

VIEW IN +y DIRECTION

LOW FREQUENCY PASSIVE GUIDANCE METHOD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Previous and current methods of attacking surface targets from the air include visual bombing and strafing and the use of a limited number of guided missiles. Visual delivery of bombs and strafing has many disadvantages, among which are (1) large number of sorties required to defeat a target due to poor accuracy, (2) high attrition rate of friendly aircraft and (3) clear weather/daylight use only because of the visual sighting requirement.

Guided missiles such as Walleye and Bullpup are also visual, clear weather, daylight systems only and therefore, cannot be used at night and during inclement weather.

The Shrike and Standard ARM missiles are, for all practical purposes, all-weather systems. However, the passive guidance system associated with both is specific to various VHF and UHF point sources and does not have broad application. Basically the two missiles are anti-radar only.

The electric and magnetic fields due to low frequency power networks have been considered and it can be shown that at distances which are large compared with the dimensions of a network, but small compared with the critical distance $\lambda/2\pi = c/\omega$, the electric and magnetic fields are essentially the same, respectively, as those due to an alternating electric dipole together with an alternating magnetic dipole of suitable complex vector moments located at an arbitrarily chosen interior point of the network. Here $\lambda$ is the wavelength, $\omega$ the angular velocity, and c the velocity of light. Unlike the situation with far field radiation, the electric and magnetic fields are essentially independent of each other — each being determined by its own dipole; also, for practical purposes the distinction between networks lies entirely in differences in the vector moments of the corresponding dipoles.

This invention describes a method for determining the direction of a dipole using field data taken at a point in space; also two guidance methods are presented which may be used to make a missile home in on the dipole. In the first of these methods, the required data is given by two sensors — one in the front of the missile, and the other in the rear. This data is adequate for homing purposes despite the fact that it is not sufficient to determine the direction of the dipole. In the second of these methods, the required data is obtained from four sensors placed at the tips of the four wings — two lateral and two vertical — of the missile. Although this data is sufficient to determine the direction of the dipole, this direction is not the one that is chosen for homing purposes.

In the case for each of these guidance methods, expressions are derived which give the error signals that would be obtained for a specified dipole, and with a specified position and orientation of the missile. This data can be used to investigate the feasibility, or calculate the performance of a given system, and also to indicate the required sensitivity of a proposed electronic and servo system.

BRIEF DESCRIPTION OF THE DRAWINGS

FIG. 8 results from FIG. 7;

FIG. 9 represents missile related vectors;

FIGS. 10*a* and 10*b* illustrates the angles $\nu$ and $\nu_1$;

DESCRIPTION OF THE PREFERRED EMBODIMENT

FIELD OF A DIPOLE

Figure 1:
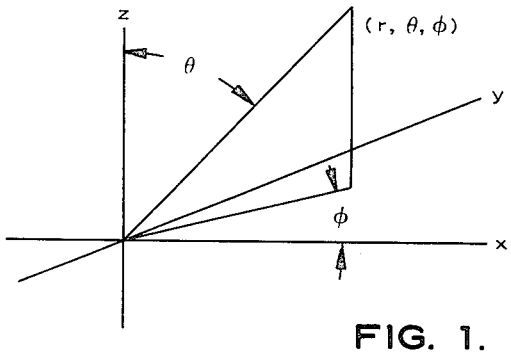
FIG. 1 illustrates the spherical coordinates of a magnetic dipole.

Using the spherical coordinates indicated in FIG. 1 and MKS units, the magnetic field of a low-frequency alternating magnetic dipole of complex vector moment $m$ located at the origin and having an axis pointing in the $+z$ direction is given by the relations $$H_r = \frac{m}{2\pi r^3}\cos\theta, \quad H_\theta = \frac{m}{4\pi r^3}\sin\theta, \quad H_\phi = 0 \tag{1}$$

where $H_r$, $H_\phi$, and $H_\theta$ are the components of the magnetic field intensity and $m$ is the (complex) magnitude of $\vec{m}$.

In the case of an electric dipole of complex vector moment $\vec{m}$, similar relations exist for the components $E_r$, $E\theta$, and $E\phi$ of electric $$E_r = \frac{m}{2\pi\epsilon_o r^3}\cos\theta, \quad E_\theta = \frac{m}{4\pi\epsilon_o r^3}\sin\theta, \quad E_\phi = 0 \tag{2}$$

where $\epsilon_o$ is the permittivity of free space. Note that there is no quantity in Equation 1 which corresponds to $\epsilon_o$ in Equation 2.

It is unusual for a complex dipole — that is, one having a complex vector dipole moment — to have an axis, since the axes of the real and imaginary parts of this moment are in general not the same. However, any complex dipole may be considered to be the sum of the two dipoles which correspond, respectively, to the real and imaginary parts of its vector moment; and both of these have axes and can be treated using Equations 1 and 2.

DETERMINATION OF THE DIRECTION OF A DIPOLE FROM A GIVEN POINT

Consider an alternating magnetic dipole of complex vector moment.

$$\vec{m} = \vec{m}_1 + j\vec{m}_2 \tag{3}$$

where $\vec{m}_1$ and $\vec{m}_2$ are real. Applying the relations of Equation 1 separately to $\vec{m}_1$ and $j\vec{m}_2$, and using the coordinates indicated in FIG. 2, the following expression for the magnetic field intensity at any point P in space is obtained.

$$H = \frac{1}{4\pi r^3}\,[l_r 2(m_1 \cos\theta_1 + jm_2 \cos\theta_2) + l_{\theta_1} m_1 \sin\theta_1 + l_{\theta_2} jm_2 \sin\theta_2] \tag{4}$$

where $m_1$ and $m_2$ are the absolute values of $\vec{m}_1$ and $\vec{m}_2$, and $l_r$, $l_{\theta_1}$, and $l_{\theta_2}$ are unit vectors in the direction of increasing $r$, $\theta_1$, and $\theta_2$, respectively. Since these unit vectors do not change when $r$ is increased, it follows that $$\frac{\delta H}{\delta r} = -\frac{3}{4\pi r^4}\,[l_r 2(m_1 \cos\theta_1 + jm_2 \cos\theta_2) + l_{\theta_1} m_1 \sin\theta_1 + l_{\theta_2} jm_2 \sin\theta_2]\,. \tag{5}$$

Comparing this expression with Equation 4, $$\delta H/\delta r = -(3/r)H \text{ results.} \tag{6}$$

Since $(-3/r)$ is a scalar quantity, at any point in space the direction of the dipole is distinguished by the fact that in that direction the directional derivative of H is a scalar quantity times H. Ordinarily this would indicate that H and its directional derivative have the same direction; however, in the present case these vectors are complex, and their "common direction" has complex direction ratios. Nevertheless, since Equation 6 is also satisfied by the real parts and by the imaginary parts of these vectors, the real parts of H and the directional derivative have the same direction and the same is true of the imaginary parts. The two directions which pertain to H thus coincide with those which pertain to the directional derivative. Finally, at each instant the H vector and its directional derivative have the said direction if instantaneous values are used instead of complex values.

Figure 2:
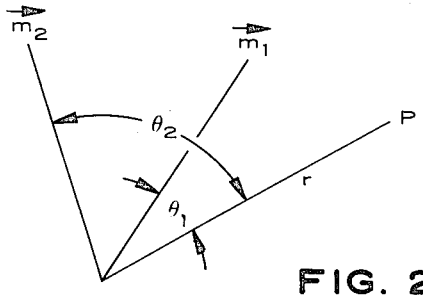
FIG. 2 space; the magnetic field intensity at any point P in space.

Since the directional derivative of a vector V in the direction of a unit vector $l_s$ is $l_s \cdot \nabla V$ (in which the operation $l \cdot \nabla$ has to be carried out first), the previous statement pertaining to the direction of a dipole at any point in space can be written as $$l_D . \nabla H = fH \tag{7}$$

where $l_D$ is a unit vector in the direction from point P, FIG. 2, to the dipole, and $f$ is a scalar function.

Applying this relation now choose any convenient $xyz$ coordinate system, and let $l_x$, $l_y$ and $l_z$ be unit vectors in the $x$, $y$ and $z$ directions, respectively. Also let $\cos\alpha$, $\cos\beta$ and $\cos\gamma$ be the direction cosines of $l_D$, and $H_x$, $H_y$ and $H_z$ be the components of magnetic field intensity. Then $$l_D = l_x \cos\alpha + l_y \cos\beta + l_z \cos\gamma$$
$$l_D \cdot \nabla = \cos\alpha \frac{\delta}{\delta x} + \cos\beta \frac{\delta}{\delta y} + \cos\gamma \frac{\delta}{\delta z} \tag{8}$$

and Equation 7 becomes $$\left(\cos\alpha \frac{\delta}{\delta x} + \cos\beta \frac{\delta}{\delta y} + \cos\gamma \frac{\delta}{\delta z}\right)(l_x H_x + l_y H_y + l_z H_z) = f(l_x H_x + l_y H_y + l_z H_z)\,. \tag{9}$$

Equating like components on the two sides of this equation $$\begin{aligned} \frac{\delta H_x}{\delta x}\cos\alpha + \frac{\delta H_x}{\delta y}\cos\beta + \frac{\delta H_x}{\delta z}\cos\gamma &= fH_x \\ \frac{\delta H_y}{\delta x}\cos\alpha + \frac{\delta H_y}{\delta y}\cos\beta + \frac{\delta H_y}{\delta z}\cos\gamma &= fH_y \\ \frac{\delta H_z}{\delta x}\cos\alpha + \frac{\delta H_z}{\delta y}\cos\beta + \frac{\delta H_z}{\delta z}\cos\gamma &= fH_z \end{aligned} \tag{10}$$

which is a set of linear algebraic equations having $\cos\alpha$, $\cos\beta$, and $\cos\gamma$ as unknowns. Here $f$ is unknown, but must be such that the three equations are compatible despite the fact that $$\cos^2\alpha + \cos^2\beta + \cos^2\gamma = 1. \tag{11}$$

Since $\nabla XH = 0$ due to quasi-stationary conditions $$\frac{\delta H_x}{\delta y} = \frac{\delta H_y}{\delta x}, \frac{\delta H_y}{\delta z} = \frac{\delta H_z}{\delta y}, \frac{\delta H_z}{\delta x} = \frac{\delta H_x}{\delta z}; \tag{12}$$

and the coefficient matrix is symmetrical.

The solution of Equation 10 is $$\begin{aligned} \cos\alpha &= fA_1, \\ \cos\beta &= fA_2, \\ \cos\gamma &= fA_3, \end{aligned} \tag{13}$$

where $A_1$, $A_2$, and $A_3$ are known quantities. Substituting in Equation 11 gives $$1 = f^2(A_1^2 + A_2^2 + A_3^2)$$
$$f = \pm \frac{1}{\sqrt{A_1^2 + A_2^2 + A_3^2}}\,. \tag{14}$$

Noting that $l_D$ and $l_r$ point in opposite directions $$f = 3/r \tag{15}$$

due to Equations 6 and 7. The plus sign must be chosen in Equation 14, which in Equation 13 then gives $$\cos\alpha = \frac{A_1}{\sqrt{A_1^2 + A_2^2 + A_3^2}}\,,$$

-continued $$\cos\beta = \frac{A_2}{\sqrt{A_1^2 + A_2^2 + A_3^2}}, \tag{16}$$

$$\cos\gamma = \frac{A_3}{\sqrt{A_1^2 + A_2^2 + A_3^2}};$$

and in Equation 15 gives $$r = 3\sqrt{A_1^2 + A_2^2 + A_3^2}. \tag{17}$$

Equation 16 gives the direction of the dipole, and Equation 17 gives the range.

In the equations of Equation 10, the unknown direction cosines and $f$ are real, whereas the partial derivatives and H components are complex. Equating separately the real and imaginary parts of the two sides of these equations results in two other sets of equations which have the same solution as Equation 10 but real coefficients. In each of these, the coefficient matrix is symmetrical. Furthermore, since in defining complex notation the position of the time origin is arbitrary, the coefficients and H components in Equation 10 may be taken as those corresponding to any desired phase.

Electric dipoles can be located in the same manner as magnetic dipoles — the presence of $\epsilon_o$ in Equation 2 makes no difference whatsoever.

POINTING OF A MISSILE TOWARD A DIPOLE

Figure 3:
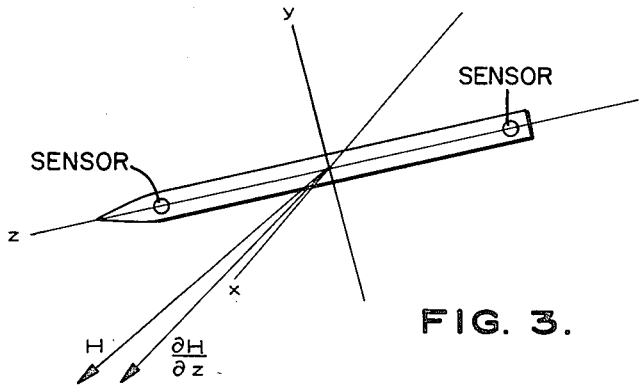
FIG. 3 illustrates missiles axes.

Now fix a set of $xyz$ axes in a missile, the origin being at the center, the $z$ axis being the axis of the missile, and the $+z$ direction being forward, as indicated in FIG. 3. Here the indication of H and $\delta H/\delta z$ is merely schematic, since both of these quantities are complex. Suppose that sensors have been placed at the ends of the missile so that the components of H and $\delta H/\delta z$ at the center of the missile are available, the field being due to an alternating magnetic dipole of complex vector moment $\vec{m}$ whose position is unknown.

The means for pointing the missile at the dipole will be discussed. Referring to Equation 6, and noting that $\delta H/\delta r$ is the directional derivative in the direction away from the dipole when the missile is pointed toward the dipole it is true that $$\delta H/\delta z = (3/r)H \tag{18}$$

where $r$ is the range. Equating like components on the two sides of this equation, results in $$\frac{\delta H_x}{\delta z} = \frac{3}{r} H_x, \quad \frac{\delta H_y}{\delta z} = \frac{3}{r} H_y, \quad \frac{\delta H_z}{\delta z} = \frac{3}{r} H_z; \tag{19}$$

from which follows that $$\frac{\frac{\delta H_x}{\delta z}}{H_x} = \frac{\frac{\delta H_y}{\delta z}}{H_y} = \frac{\frac{\delta H_z}{\delta z}}{H_z} = \frac{3}{r}. \tag{20}$$

If the direction of the missile axis should deviate from that toward the dipole, the relations of Equation 20 will be violated and some measure of the extent of this violation can be taken as the basis of error signals which activate a servo system to keep the missile on course. Whether Equation 20 or some other equivalent relations are used, and just how error signals are obtained from the chosen relations will be dictated by the following two considerations.

A. Can the quantities which appear in the expressions for the error signals be easily obtained?

B. Can the error signals be easily used to achieve the desired result?

It can be shown mathematically that fractions composed of the real parts and imaginary parts of the numerator and denominator, respectively, are equal to the original complex fraction. Also, the quotient of the absolute values of the numerator and denominator of two complex numbers is equal to the original fraction if the latter is positive and the ratio of two linear combinations of the numerator and denominator involves only the original ratio and the coefficients in the linear combinations — not the numerator and denominator themselves. In addition, if a number of fractions are equal, the ratio of any linear combination of the numerators to the same linear combination of the denominators is equal to the common value of the original fractions.

From the above, the following equations result in addition to Equation 20.

$$\frac{Re\left(\frac{\delta H_x}{\delta z}\right)}{Re\,H_x} = \frac{Re\left(\frac{\delta H_y}{\delta z}\right)}{Re\,H_y} = \frac{Re\left(\frac{\delta H_z}{\delta z}\right)}{Re\,H_z} = \frac{3}{r}, \tag{21}$$

$$\frac{Im\left(\frac{\delta H_x}{\delta z}\right)}{Im\,H_x} = \frac{Im\left(\frac{\delta H_y}{\delta z}\right)}{Im\,H_y} = \frac{Im\left(\frac{\delta H_z}{\delta z}\right)}{Im\,H_z} = \frac{3}{r}, \tag{22}$$

$$\frac{\left|\frac{\delta H_x}{\delta z}\right|}{|H_x|} = \frac{\left|\frac{\delta H_y}{\delta z}\right|}{|H_y|} = \frac{\left|\frac{\delta H_z}{\delta z}\right|}{|H_z|} = \frac{3}{r} \tag{23}$$

where $Re$ and $Im$ denote real and imaginary parts, respectively.

Second, suppose that sensors — triple loops, for example — are mounted in the front and rear of the missile, so that $H_x$, $H_y$ and $H_z$ are available at the two ends. If data pertaining to the $f$ front and rear of the missile is distinguished by additional subscripts 1 and 2, respectively, and if L denotes the length of the missile, $$\frac{\delta H_x}{\delta z} = \frac{1}{L}(H_{x1} - H_{x2}), \quad \frac{\delta H_y}{\delta z} = \frac{1}{L}(H_{y1} - H_{y2}),$$

$$\frac{\delta H_z}{\delta z} = \frac{1}{L}(H_{z1} - H_{z2}); \quad H_x = \frac{1}{2}(H_{x1} + H_{x2}), \tag{24}$$

$$H_y = \frac{1}{2}(H_{y1} + H_{y2}), \quad H_z = \frac{1}{2}(H_{z1} + H_{z2});$$

and Equation 20 becomes $$\frac{H_{x1} - H_{x2}}{H_{x1} + H_{x2}} = \frac{H_{y1} - H_{y2}}{H_{y1} + H_{y2}} = \frac{H_{z1} - H_{z2}}{H_{z1} + H_{z2}} = \frac{3L}{2r}. \tag{25}$$

Here, as before, the numerators and denominators may be replaced by their real parts, their imaginary parts, or their absolute values. In the last of these cases, $$\frac{|H_{x1} - H_{x2}|}{|H_{z1} + H_{x2}|} = \frac{|H_{y1} - H_{y2}|}{|H_{y1} + H_{y2}|} = \frac{|H_{z1} - H_{z2}|}{|H_{z1} + H_{z2}|} = \frac{3L}{2r}. \tag{26}$$

From the mathematical relationships previously stated consider any fraction $A/B = \sigma$ where the quantities involved need not be real; then for any choice of the quantities $a$, $b$, $c$ and $d$ $$\frac{aA + bB}{cA + dB} = \frac{a\sigma B + bB}{c\sigma B + dB} = \frac{a\sigma + b}{c\sigma + d}. \tag{27}$$

Now, applying Equation 27 with $$a = \frac{1}{2},\ b = \frac{1}{2},\ c = -\frac{1}{2},\ d = \frac{1}{2} \tag{28}$$

$$\frac{H_{x1}}{H_{x2}} = \frac{H_{y1}}{H_{y2}} = \frac{H_{z1}}{H_{z2}} = \frac{2r + 3L}{2r - 3L} \tag{29}$$

results in place of Equation 25.

Here, too, the numerators and denominators may be replaced by their real parts, their imaginary parts, or their absolute values. In the last of these cases, $$\frac{|H_{x1}|}{|H_{x2}|} = \frac{|H_{y1}|}{|H_{y2}|} = \frac{|H_{z1}|}{|H_{z2}|} = \frac{2r + 3L}{2r - 3L}. \tag{30}$$

As a third application, suppose that due to the presence of extraneous material — possibly ferromagnetic — the field is distorted, and instead of $H_x$, $H_y$, and $H_z$, the sensors give $$\begin{aligned} \bar{H}_x &= a_1H_x + a_2H_y + a_3H_z \\ \bar{H}_y &= b_1H_x + b_2H_y + b_3H_z \\ \bar{H}_z &= c_1H_x + c_2H_y + c_3H_z \end{aligned} \tag{31}$$

where the coefficients are complex constants; then applying the last of the previously stated mathematical relationships with $$a = a_1,\ b = a_2,\ c = a_3 \tag{32}$$

to Equation 29 results in $$\frac{\bar{H}_{x1}}{\bar{H}_{x2}} = \frac{H_{x1}}{H_{x2}},$$

and similar expressions for the $y$ and $z$ components. Then $$\frac{\bar{H}_{x1}}{\bar{H}_{x2}} = \frac{\bar{H}_{y1}}{\bar{H}_{y2}} = \frac{\bar{H}_{z1}}{\bar{H}_{z2}} = \frac{2r + 3L}{2r - 3L} \tag{33}$$

and the same relations are obtained for the raw data that would be obtained for the corrected data if compensation were made for field distortion. As usual, the numerators and denominators in Equation 33 may be replaced by the real parts, their imaginary parts, or their absolute values. In the last of these cases we have $$\frac{|\bar{H}_{x1}|}{|\bar{H}_{x2}|} = \frac{|\bar{H}_{y1}|}{|\bar{H}_{y2}|} = \frac{|\bar{H}_{z1}|}{|\bar{H}_{z2}|} = \frac{2r + 3L}{2r - 3L} \tag{34}$$

If, using the same coefficients, the foregoing relationship had been applied to Equation 25 instead of Equation 29, the results would have been $$\frac{\bar{H}_{x1} - \bar{H}_{x2}}{\bar{H}_{x1} + \bar{H}_{x2}} = \frac{\bar{H}_{y1} - \bar{H}_{y2}}{\bar{H}_{y1} + \bar{H}_{y2}} = \frac{\bar{H}_{z1} - \bar{H}_{z2}}{\bar{H}_{z1} + \bar{H}_{z2}} = \frac{3L}{2r} \tag{35}$$

Here again, the numerators and denominators may be replaced by their real parts, their imaginary parts, or their absolute values. In the last of these cases $$\frac{|\bar{H}_{x1} - \bar{H}_{x2}|}{|\bar{H}_{x1} + \bar{H}_{x2}|} = \frac{|\bar{H}_{y1} - \bar{H}_{y2}|}{|\bar{H}_{y1} + \bar{H}_{y2}|} = \frac{|\bar{H}_{z1} - \bar{H}_{z2}|}{|\bar{H}_{z1} + \bar{H}_{z2}|} = \frac{3L}{2r} \text{ results.} \tag{36}$$

CALCULATION OF THE DIRECTIONAL DERIVATIVE $\delta H/\delta s$

Figure 4:
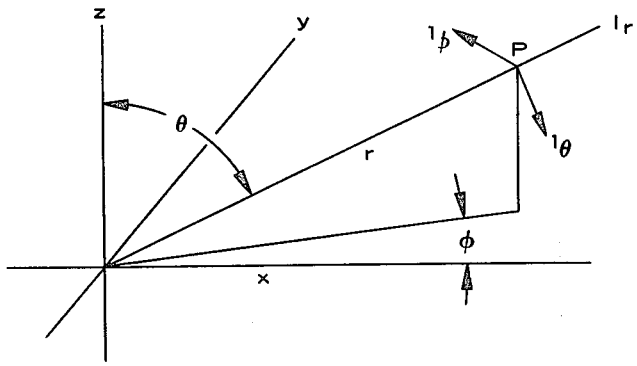
FIG. 4 illustrates the vector relationship for an alternating dipole of complex vector $\vec{m}$.

Regardless of which expressions are ultimately chosen as the basis for error signals, an expression for $\delta H/\delta s$ is needed in order to be able to calculate numerical values of these signals when the missile is off course. Accordingly, consider an alternating dipole of complex vector moment $\vec{m}$ placed at the origin and having an axis pointing in the $+z$ direction, as indicated in FIG. 4.

As previously stated, the most general alternating dipole is composed of two such dipoles — one for the real part of the vector moment, and one for the imaginary part. The components of magnetic field intensity are given by Equation 1, which expressions are of the form $$\begin{aligned} H_r &= F(r)f(\theta) \\ H_\theta &= F(r)g(\theta) \\ H_\phi &= 0; \end{aligned} \tag{37}$$

and it is desired to calculate the directional derivative $\delta H/\delta s$ at point P in the direction of the unit vector $l_s$, where $$l_s = l_r a + l_\theta b + l_\phi c, \tag{38}$$

and $l_r$, $l_\theta$, and $l_\phi$ are unit vectors in the directions of increasing $r$, $\theta$ and $\phi$, respectively. Using calculus, $$\begin{aligned} \frac{\delta H}{\delta s} &= l_s \cdot \nabla H = l_s \cdot \nabla(l_rH_r + l_\theta H_\theta + l_\phi H_\phi) \\ \nabla &= l_r\frac{\delta}{\delta r} + l_\theta\frac{1}{r}\frac{\delta}{\delta\theta} + l_\phi\frac{1}{r\sin\theta}\frac{\delta}{\delta\phi} \\ l_s \cdot \nabla &= a\frac{\delta}{\delta r} + \frac{b}{r}\frac{\delta}{\delta\theta} + \frac{c}{r\sin\theta}\frac{\delta}{\delta\phi} \end{aligned} \tag{39}$$

Hence, noting Equation 37, $$\frac{\delta H}{\delta s} = \tag{40}$$

-continued $$\left(a\frac{\delta}{\delta r}+\frac{b}{r}\ \frac{\delta}{\delta\theta}+\frac{c}{r\sin\theta}\ \frac{\delta}{\delta\theta}\right)$$

$$(l_rF(r)f(\theta)+l_\theta F(r)g(\theta)\,.$$

In order to carry out the differentiations, the derivatives of the unit vectors must be known. Since $$l_r = l_x\sin\theta\cos\phi + l_y\sin\theta\sin\phi + l_z\cos\theta\,, \tag{41}$$

$$l_\theta = l_x\cos\theta\cos\phi + l_y\cos\theta\sin\phi - l_z\sin\theta$$

$$l_\phi = -l_x\sin\phi + l_y\cos\phi$$

where $l_x$, $l_y$ and $l_z$ are unit vectors in the directions of increasing $x$, $y$, and $z$, respectively; and since $l_x$, $l_y$ and $l_z$ are constant vectors, it follows that $$\frac{\delta l_r}{\delta r}=0\,, \tag{42}$$

$$\frac{\delta l_\theta}{\delta r}=0\,,$$

$$\frac{\delta l_\phi}{\delta r}=0\,,$$

$$\frac{\delta l_r}{\delta\theta}=l_x\cos\theta\cos\phi+l_y\cos\theta\sin\phi-l_z\sin\theta=l_\theta\,,$$

$$\frac{\delta l_\theta}{\delta\theta}=-l_x\sin\theta\cos\phi-l_y\sin\theta\sin\phi-l_z\cos\theta=-l_r\,,$$

$$\frac{\delta l_\phi}{\delta\theta}=0\,,$$

$$\frac{\delta l_r}{\delta\phi}=-l_x\sin\theta\sin\phi+l_y\sin\theta\cos\phi=l_\phi\sin\theta\,,$$

$$\frac{\delta l_\theta}{\delta\phi}=-l_x\cos\theta\sin\phi+l_y\cos\theta\cos\phi=l_\phi\cos\theta\,,$$

$$\frac{\delta l_\phi}{\delta\phi}=-l_x\cos\phi-l_y\sin\phi=-l_r\sin\theta-l_\theta\cos\theta\,.$$

Applying these relations, Equation 40 becomes $$\frac{\delta H}{\delta s}=l_r\left\{aF'(r)f(\theta)+\frac{b}{r}\,[F(r)f'(\theta)-F(r)g(\theta)]\right\} \tag{43}$$

$$+\,l_\theta\left\{aF'(r)g(\theta)+\frac{b}{r}\,[F(r)g'(\theta)+F(r)f(\theta)]\right\}$$

$$+\,l_\phi\frac{c}{r\sin\theta}\,\{F(r)f(\theta)\sin\theta+F(r)g(\theta)\cos\theta\}$$

where the primes indicate differentiation. Placing $$F(r)=m/(4\pi r^3),$$

$$f(\theta)=2\cos\theta, \tag{44}$$

$$g(\theta)=\sin\theta$$

in accordance with Equation 1, the following obtain:

$$\frac{\delta H}{\delta s}=\frac{m}{4\pi r^4}\left\{l_r[-6a\cos\theta+b(-2\sin\theta-\sin\theta)]\right. \tag{45}$$

$$+\,l_\theta[-3a\sin\theta+b(\cos\theta+2\cos\theta)]$$

-continued $$\left.+\,l_\phi\frac{c}{\sin\theta}\,[2\cos\theta\sin\theta+\sin\theta\cos\theta]\right\}$$

$$\frac{\delta H}{\delta s}=-\frac{3m}{4\pi r^4}\,[l_r(2a\cos\theta+b\sin\theta)$$

$$+\,l_\theta(a\sin\theta-b\cos\theta)-l_\phi c\cos\theta]\,.$$

Here it is noted that $m$ is the (complex) absolute value of $\vec{m}$, and that $a$, $b$, and $c$ are the direction cosines of $l_s$ with respect to the orthogonal curvilinear coordinate system $l_r$, $l_\theta$, $l_\phi$. Also, it is seen that $\delta H/\delta s$ does not contain $\phi$, and that $r$ appears only in the factor $l/r^4$.

The nature and behavior of $\delta H/\delta s$ can be visualized graphically as follows. Omitting the external factor in Equation 45, which varies only with distance, the remaining bracket may be written $$D=-\frac{4\pi r^4}{3m}\ \frac{\delta H}{\delta s}=l_r[l_s\cdot(l_r2\cos\theta+l_\theta\sin\theta)] \tag{46}$$

$$+\,l_\theta[l_s\cdot(l_r\sin\theta-1\cos\theta)]$$

$$-\,l_\phi[l_s\cdot l_\phi\cos\theta]\,.$$

Noting that the dot product $l_s\cdot V$ is merely the projection of the vectors V on $l_s$, it is seen that if the vectors $$V_1=l_r2\cos\theta+l_\theta\sin\theta,$$
$$V_2=l_r\sin\theta-l_\theta\cos\theta,$$
$$V_3=-l_\phi\cos\theta \tag{47}$$

are placed in a rectangular coordinate system whose axes have the directions of $l_r$, $l_\theta$, and $l_\phi$; then the $r$, $\theta$, and $\phi$ components of D are the projections of these vectors on $l_s$, respectively, or — what is the same thing — the direction of $l_s$.

Figure 5:
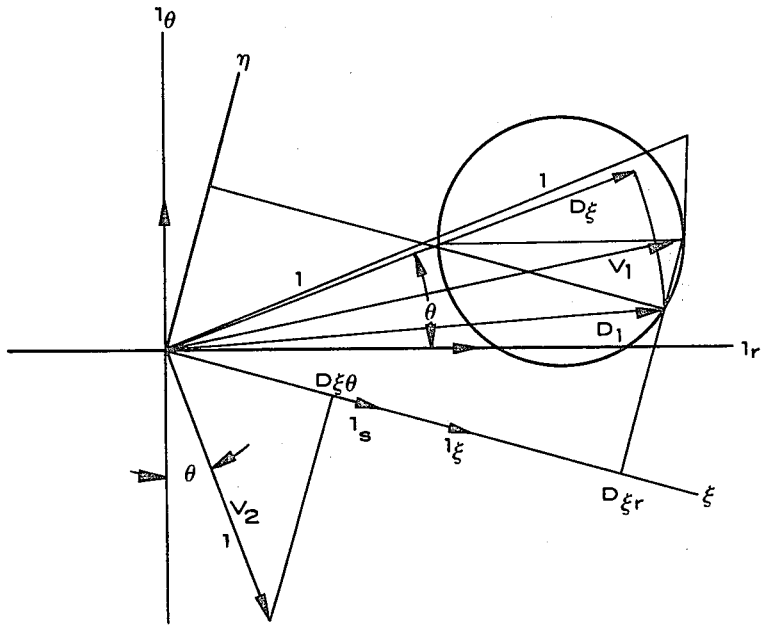
FIG. 5 is a vector diagram using a coordinate system whose axes have directions of $l_r$, $l_\theta$ and $l_\phi$.

If one looks in the $(-l_\phi)$ direction, the situation is as indicated in FIG. 5, in which the construction that give $V_1$ and $V_2$ in the plane of $l_r$ and $l_\theta$ are evident. The $\xi\eta$ axes shown are also in this plane; and in this view the $+\xi$ axis has the direction of $l_s$. The $l_s$ may be written as the sum of two component vectors — one along the $\xi$ axis, and on along the $l_\phi$ axis, thus, noting Equation 38, $$l_s=al_r+bl_\theta+cl_\phi=\alpha l_\xi+cl_\phi \tag{48}$$

It follows that $$l_\xi=\frac{a}{\alpha}\,l_r+\frac{b}{\alpha}\,l_\theta\,, \tag{49}$$

$$l=\left(\frac{a}{\alpha}\right)^2+\left(\frac{b}{\alpha}\right)^2,$$

$$\alpha=\sqrt{a^2+b^2}=\sqrt{1-c^2}\,,$$

since the sum of the squares of the direction cosines $a$, $b$, and $c$ is 1. Substituting Equation 49 in 48 now gives $$l_s=\sqrt{1-c^2}\,l_\xi+cl_\phi; \tag{50}$$

from Equations 46 and 47, it is seen that $$D=\sqrt{1-c^2}\,[l_r(l_\xi\cdot V_1)+l_\theta(l_\xi\cdot V_2)]-l_\phi c\cos\theta \tag{51}$$

Denoting the bracket by $D_\xi$, since it duplicates the value which would be obtained for D if $l_s$ coincided with $l_\xi$, results in $$D_\xi=l_r(l_\xi\cdot V_1)+l_\theta(l_\xi\cdot V_2) \tag{52}$$

$$D = \sqrt{l - c^2} D_\xi - l_\phi c \cos\theta \tag{53}$$

Figure 6:
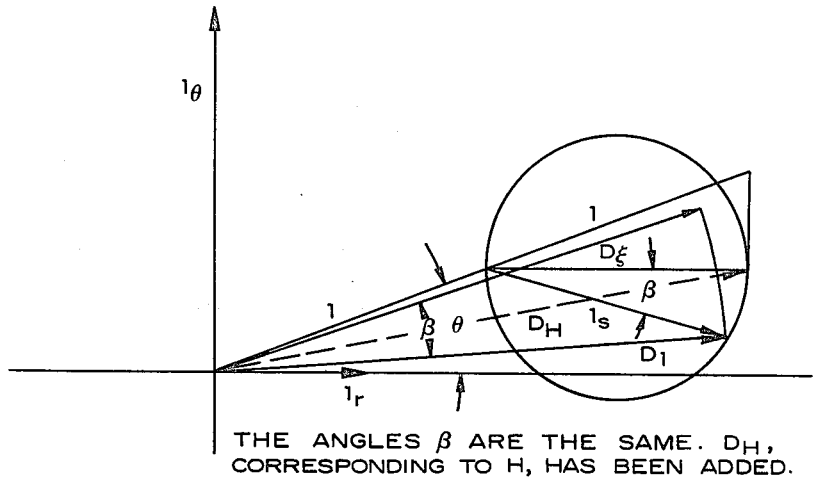
FIG. 6 results from FIG. 5.

Denoting the components of $D_\xi$ by $D_{\xi r}$ and $D_{\xi\theta}$, it is seen from Equation 5 that $D_{\xi r}$ and $D_{\xi\theta}$ are the projections of $V_1$ and $V_2$ on the $\xi$ axis, respectively, as indicated in FIG. 5. If these components could be laid off along the $l_r$ and $l_\theta$ directions the $D_\xi$ vector could be built up. Now rotate $V_2$ and the $D_{\xi\theta}$ projection 90° counterclockwise as indicated; then it is seen that the vector $D_1$ bears the same relation to the $\xi$ and $\eta$ axes that $D_\xi$ does to the $l_r$ and $l_\theta$ axes. It follows that a final rotation of the $\xi$ and $\eta$ axes and the $D_1$ vector, so that the $\xi$ axis is brought into coincidence with the $l_r$ axis, brings the $D_1$ vector into coincidence with the $D_\xi$ vector. Note that if $\theta$ is held fixed while $l_s$ is varied, the locus of the tip of the $D_1$ vector is a circle, as indicated. FIG. 6 is obtained from FIG. 5 by retaining only that construction necessary to obtain $D_\xi$.

Figure 7:
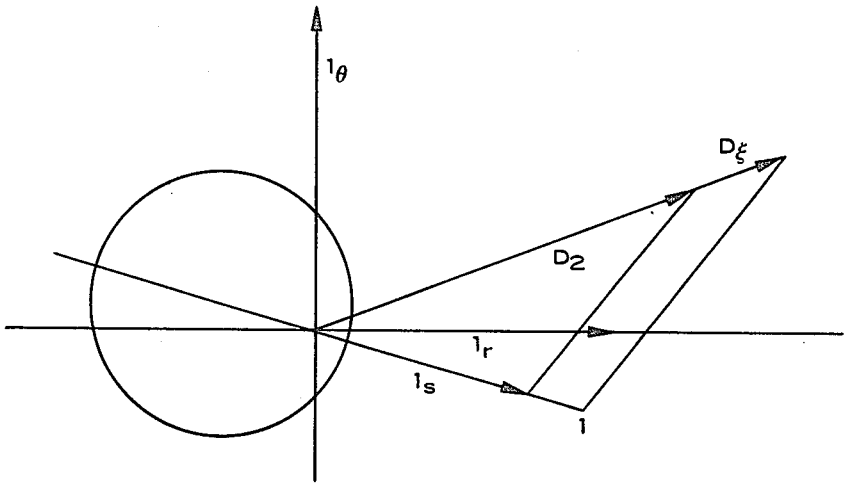
FIG. 7 illustrates the contraction of $D\xi$ from FIG. 6.

In order to obtain D, one must multiply $D_\xi$ by $\sqrt{l - c^2}$ and add the $l_\phi$ component vector $(-l_\phi c \cos\theta)$, in accordance with Equation 53. The apparent length of the unit vector $l_s$ in FIG. 6 is $\sqrt{l - c^2}$; hence the construction shown in FIG. 7 accomplishes the desired contraction of $D_\xi$, and gives $D_2$, which is the component vector of D in the $l_r l_\theta$ plane. The $l_\phi$ component of D can be obtained by affixing a sphere to the extended tail of the $l_s$ vector drawn from the origin. This sphere passes through the origin, has the extension of the $l_s$ vector as a diameter, and is of diameter $\cos\theta$; hence it appears to be the same size as the circle in FIG. 6. It now follows that the $l_\phi$ component vector of D is the vector which extends from the origin to the point where the $l_\phi$ axis intersects the sphere, as indicated in FIG. 8. The sphere is also shown in FIG. 7, although in this view $l_\phi$ component vector of D cannot be seen. Having the two component vectors which compose D, this vector can be easily visualized or constructed.

DETERMINATION OF THE DIRECTION IN WHICH THE MISSILE IS OFF COURSE

The expressions for error signals, which indicate the extent to which $\delta H/\delta z$ deviates in direction from H, will be chosen. However, knowing these, how can one tell which way to alter the direction of the missile to get it back on course? The three vectors H, $\delta H/\delta z$, and $l_z$ are available, the direction of the target dipole is not known. Using the notation of the preceding section are available $D_H$, D, and $l_s$, but not $l_r$. $D_H$ corresponds to H, and differs from H only in that the factor $m/4\pi r^3$ has been removed, thus $$D_H = l_r 2\cos\theta + l\theta \sin\theta. \tag{54}$$

For convenience this vector is shown dotted in FIG. 6, thought it plays no role in the construction. It is desirable to know which way to move $l_s$, the missile axis, in order to bring it into coincidence with $l_r$, the direction from the target.

From FIGS. 6, 7, and 8, it is seen what happens to the D vector when $l_s$ is moved around, $\theta$ being held constant. In particular, start with $l_s$ parallel to $l_r$, in which case $D = D_2 = D_\xi$ coincides in direction with $D_H$; then tilt $l_s$ toward $l_r$ axis in the $l_r l_\phi$ plane. $c = 0$, and $D = D_2 = D_\xi$ changes its direction relative to $D_H$ in the $l_r l_\theta$ plane in the opposite sense from that in which $l_s$ changes its direction relative to $l_r$. Again, starting with $l_s$ parallel to $l_r$ tilt $l_s$ upward, increasing $c$ but holding $\theta$ and $\beta$ constant, the latter being 0. $D_\xi$ then remains unaltered, but $D_2$ is shorter than $D_\xi$, and D has a negative $l_\phi$ component. It follows that now, as before, D tilts away from $D_H$ in the opposite sense from that in which $l_s$ tilts away from $l_r$.

In view of these results, if it is generally true that D differs in direction from $D_H$ in the opposite sense from that in which $l_s$ differs from $l_r$ then it would be possible in response to an error signal, to tilt the missile axis in that way which would move $D_H$ toward D, and thereby bring the missile axis $l_s$ into coincidence with the target direction $l_r$.

Both the axis and sense of the rotation which would bring the direction of $D_H$ into coincidence with that of D are given by the vector product $$A_D = D_H \times D. \tag{55}$$

Similarly, the axis and sense of the rotation which would bring $l_s$ into coincidence with $l_r$ are given by $$A_s = l_s \times l_r \tag{56}$$

The angle $\Psi$ between the directions of these two axes is given by the relation $$\cos\psi = \frac{(D_H \times D)\cdot(l_s \times l_r)}{|D_H \times D|\,|l_s \times l_r|}. \tag{57}$$

Noting Equations 48, 55, 56, and 64, and the vector relation $$(A \times B)\cdot(C \times D) = (A\cdot C)(B\cdot D) - (A\cdot D)(B\cdot C), \tag{58}$$

it is seen that $$\begin{aligned}(D_H \times D)\cdot(l_s \times l_r) &= (2a\cos\theta + b\sin\theta)\times(2a\cos\theta + b\sin\theta) \\ &\quad - 2\cos\theta\,[a(2a\cos\theta + b\sin\theta) \\ &\quad + b(a\sin\theta - b\cos\theta) - c^2\cos\theta] \\ &= 4a^2\cos^2\theta + 4ab\cos\theta\sin\theta + b^2\sin^2\theta \\ &\quad - 4a^2\cos^2\theta - 2ab\cos\theta\sin\theta - 2ab\cos\theta\sin\theta \\ &\quad + 2b^2\cos^2\theta + 2c^2\cos^2\theta \\ &= b^2\sin^2\theta + 2(b^2 + c^2)\cos^2\theta \\ (D_H \times D)\cdot(l_s \times l_r) &= b^2(1 + \cos^2\theta) + 2c^2\cos^2\theta.\end{aligned} \tag{59}$$

This expression is nonnegative; hence $\Psi$ cannot be obtuse. Continuing, $$\begin{aligned}D_H \times D &= \begin{vmatrix} l_r & l_\theta & l_\phi \\ 2\cos\theta & \sin\theta & 0 \\ 2a\cos\theta + b\sin\theta & a\sin\theta - b\cos\theta & -c\cos\theta \end{vmatrix} \\ &= \begin{vmatrix} l_r & l_\theta & l_\phi \\ 2\cos\theta & \sin\theta & 0 \\ b\sin\theta & -b\cos\theta & -c\cos\theta \end{vmatrix} \\ &= l_r(-c\sin\theta\cos\theta) + l_\theta 2c\cos^2\theta + l_\phi(-2b\cos^2\theta - b \\ D_H \times D &= -l_r c\sin\theta\cos\theta + l_\theta 2c\cos^2\theta - l_\phi b(1 + \cos^2\theta).\end{aligned} \tag{60}$$

$$|D_H \times D|^2 = c^2\sin^2\theta\cos^2\theta + 4c^2\cos^4\theta + b^2(1 + \cos^2\theta)^2$$

$$|D_H \times D| = \sqrt{c^2\cos^2\theta(1 + 3\cos^2\theta) + b^2(1 + \cos^2\theta)^2}\;; \tag{61}$$

also $$|l_s \times l_r| = \sin\widehat{l_s l_r} = \sqrt{1 - a^2} = \sqrt{b^2 + c^2}. \tag{62}$$

Substituting Equations 59, 61, and 62 in Equation 67 results in $$\cos\psi = \frac{b^2(1+\cos^2\theta)+2c^2\cos^2\theta}{\sqrt{b^2+c^2}\ \sqrt{c^2\cos^2\theta\,(1+3\cos^2\theta)+b^2(1+\cos^2\theta)}} \tag{63}$$

Noting that $b$ and $c$ are the projections of $l_s$ on the $l_\theta$ and $l_\phi$ axes, respectively, assume $$\rho = \tan\nu = c/b \tag{64}$$

$\rho$ being the slope and $\nu$ the angle of slope of $l_s$ when viewed in the $(-1_r)$ direction. Equation 63 then becomes $$\cos\psi = \frac{1+(1+2\rho^2)\cos^2\theta}{\sqrt{1+\rho^2}\ \sqrt{\rho^2\cos^2\theta\,(1+3\cos^2\theta)+(1+\cos^2\theta)^2}} \tag{65}$$

or $$\cos\psi = \frac{|\cos\nu|\,[1+(1+2\rho^2)\cos^2\theta]}{\sqrt{\rho^2\cos^2\theta\,(1+3\cos^2\theta)+(1+\cos^2\theta)^2}} \tag{66}$$

from which it is seen that $\Psi$ depends upon $b$ anc $c$ only through their ratio. Using $\nu$, the apparent angle of slope of $l_s$ to specify $\rho$, results in the values of $\Psi$ tabulated in Table 1. Values of cos $\Psi$ are tabulated in Table 2, these being included because cos $\Psi$ is the fraction of the restoring torque applied at any instant which is effective in reducing the angle between $l_s$ and $l_r$ – that is, the error in the direction of the missile axis.

TABLE 1.

| | | Values of $\psi$ | | | | | |
|---|---|---|---|---|---|---|---|
| $\theta$ | $\nu$ 0° | 15° | 30° | 45° | 60° | 75° | 90° |
| 0° | 0 | 0 | 0 | 0 | 0 | 0 | 0 |
| 15° | 0 | 0 | 3°37′ | 5°8′ | 6°47′ | 8°6′ | 7°15′ |
| 30° | 0 | 4°26′ | 7°41′ | 11°28′ | 14°4′ | 16°16′ | 15°50′ |
| 45° | 0 | 5°44′ | 13°20′ | 19°5′ | 23°4′ | 25°43′ | 26°37′ |
| 60° | 0 | 10°15′ | 20°17′ | 29°11′ | 35°48′ | 39°49′ | 40°53′ |
| 75° | 0 | 13°20′ | 26°52′ | 39°39′ | 51°19′ | 59°36′ | 61°50′ |
| 90° | 0 | 15° | 30° | 45° | 60° | 75° | 90° |

TABLE 2.

| | | Values of cos $\psi$ | | | | | |
|---|---|---|---|---|---|---|---|
| | $\nu$ | | | | | | |
| $\theta$ | 0° | 15° | 30° | 45° | 60° | 75° | 90° |
| 0° | 1.000 | 1.000 | 1.000 | 1.000 | 1.000 | 1.000 | 1.000 |
| 15° | 1.000 | 1.000 | .998 | .996 | .993 | .990 | .992 |
| 30° | 1.000 | .997 | .991 | .980 | .970 | .960 | .962 |
| 45° | 1.000 | .995 | .973 | .945 | .920 | .901 | .894 |
| 60° | 1.000 | .984 | .938 | .873 | .811 | .768 | .756 |
| 75° | 1.000 | .973 | .892 | .770 | .625 | .506 | .472 |
| 90° | 1.000 | .966 | .866 | .707 | .500 | .259 | 0 |

Actually, torque would not be applied to the missile which has any component along the missile axis, since such a component would merely tend to spin the missile about its axis. Instead, such a component would first be removed, so the resulting torque vector is perpendicular to the axis. Accordingly, instead of taking $A_D$ as the axis of rotation take $A_R$, where $$A_R = A_D - (l_s \cdot A_D)\, l_s \tag{67}$$

This vector is evidently obtained by projecting $A_D$ onto a plane perpendicular to the missile axis $l_s$. It is evident from FIG. 9 that the angle between the desired but unknown axis $A_s$ and $A_R$ cannot exceed and may be very much smaller than the angle between $A_s$ and $A_D$, which is that to which the data in Table 1 and Table 2 pertain. In replacing $A_D$ by $A_R$ as the axis of the restoring torque — or, more properly, the restoring angular displacement a situation results which is considerably more favorable than that indicated by Table 1.

In order to obtain the angle between $A_R$ and $A_s$ it is noted that the vector $l_s$ and $A_D$ lies in a plane perpendicular to $l_s$, and makes an angle with $A_s$ which if acute is complementary to the angle between $A_s$ and $A_R$, and if abtuse exceeds this angle by 90°. Denoting the angle between $A_s$ and $A_R$ by $\overline{\Psi}$, it follows that $$\sin\bar{\psi} = |\cos\widehat{A_s l_s \times A_D}| = \frac{|A_s \cdot l_s \times A_d|}{|A_s|\ |l_s \times A_D|} \tag{68}$$

Noting Equation 48, results that $$A_s = l_s \times l_r = \begin{vmatrix} l_r & l_\theta & l_\phi \\ a & b & c \\ 1 & 0 & 0 \end{vmatrix} = l_\theta c - l_\phi b \tag{69}$$

$$|A_s| = \sqrt{b^2+c^2} \tag{70}$$

Also, from Equations 55 and 60, gives $$A_D = D_H \times D = -\,l_r c \sin\theta\cos\theta\, l2c\cos^2\theta - l\phi b(l+\cos^2\theta) \tag{71}$$ 41 hence $$l_s \times A_D = \begin{vmatrix} l_r & l_\theta & l_\phi \\ a & b & c \\ -c\sin\theta\cos\theta & 2c\cos^2\theta & -b(1+\cos^2\theta) \end{vmatrix} \tag{72}$$

$$\begin{aligned} l_s \times A_D = {} & l_r[-b^2(1+\cos^2\theta) - 2c^2\cos^2\theta] \\ & + l_\theta[-c^2\sin\theta\cos\theta + ab(1+\cos^2\theta)] \\ & + l_\phi[2ac\cos^2\theta + bc\sin\theta\cos\theta]. \end{aligned}$$

Now, in addition to Equation 74 assume $$\rho_1 = \tan\nu_1 = a/b \quad (73)$$

it follows that $$A_s = b(\rho l_\theta - l_\phi); \tag{74}$$

$$|A_s| = |b|\sqrt{l+\rho^2}; \tag{75}$$

$$\begin{aligned} l_s \times A_D = {} & -l_r b^2[1+\cos^2\theta+2\rho^2\cos^2\theta] \\ & + l_\theta b^2[-\rho^2\sin\theta\cos\theta + \rho_1(1+\cos^2\theta)] \\ & + l_\phi b^2\rho\,[2\rho_1\cos^2\theta + \sin\theta\cos\theta]; \end{aligned} \tag{76}$$

$$\begin{aligned} A_s \cdot l_s \times A_D = {} & b^3\rho\,[-\rho^2\sin\theta\cos\theta + \rho_1(1+\cos^2\theta) \\ & -2\rho_1\cos^2\theta - \sin\theta\cos\theta] \end{aligned} \tag{77}$$

$$A_s \cdot l_s \times A_D = b^3\rho\sin\theta\,[\rho_1\sin\theta - (1+\rho^2)\cos\theta]$$

In applying Equation 68 to compute sin $\overline{\Psi}$ the numerator is given by Equation 77, and $|A_s|$ by Equation 75; and $|l_s \times A_D|$ is computed from Equation 76. b cancels out, and may hence be omitted.

The angles $\upsilon$ and $\upsilon_1$ are shown in FIG. 10. Substituting Equations 64 and 73 Equation 78, gives $$(\rho_1 b)^2 + b^2 + (\rho b)^2 = 1$$

$$b = \frac{\pm 1}{\sqrt{1+\rho^2+\rho_1^2}} \tag{78}$$

wherein the appropriate sign must be chosen. The direction cosines $a$ and $c$ are now given by Equations 73 and 64, respectively.

In Table 1, for any value of $\upsilon$, the worst value of $\theta$ is 90°. Replacing $A_D$ by $A_R$ as an axis, and replacing $\Psi$ by $\overline{\Psi}$ improves the situation. Placing $\theta = 90°$, Equations 76 and 77 give ps $$l_s \times A_D = -l_r b^2 + \theta b^2 \rho l$$

$$|l_s \times A_D| = b^2 \sqrt{l + \rho_1^2} \tag{79}$$

$$\text{i } A_s \cdot l_s \times A_D = b^3 \rho \rho l$$

which with Equation 75 in Equation 68 give $$\sin \overline{\psi} = \frac{|\rho \rho_1|}{\sqrt{1+\rho^2}\ \sqrt{1+\rho_1^2}} = |\sin \nu \sin \nu_1| \tag{80}$$

Values of $\overline{\Psi}$ for various values of $\nu$ and $\nu_1$ with $\theta = 90°$ are given in Table 3. Note that although the entries in the last row are the same as those in the last row of Table 1, the entries in the other rows are smaller — much smaller if $\nu_{1\,a}$ is small.

TABLE 3.

| | Values of $\overline{\psi}$ for $\theta = 90°$ | | | | | | |
|---|---|---|---|---|---|---|---|
| $\nu_1$ \ $\nu$ | 0° | 15° | 30° | 45° | 60° | 75° | 90° |
| 0° | 0 | 0 | 0 | 0 | 0 | 0 | 0 |
| 15° | 0 | 3°51′ | 7°26′ | 10°33′ | 12°57′ | 14°29′ | 15°0′ |
| 30° | 0 | 7°26′ | 14°29′ | 20°44′ | 25°40′ | 28°53′ | 30°0′ |
| 45° | 0 | 10°33′ | 20°44′ | 30°0′ | 37°49′ | 43°10′ | 45°0′ |
| 60° | 0 | 12°57′ | 25°40′ | 37°49′ | 48°36′ | 56°50′ | 60°0′ |
| 75° | 0 | 14°29′ | 28°53′ | 43°10′ | 56°50′ | 69°4′ | 75°0′ |
| 90° | 0 | 15°0′ | 30°0′ | 45°0′ | 60°0′ | 75°0′ | 90°0′ |

The worst column in Table 1 is that on the extreme right, for which $\nu = 90°$. In regard to this, note from FIG. 10 that when $\nu = 90°$, $l_s = l_\phi$ regardless of $\nu_1$ unless $\nu_1 = 90°$. When $l_s = l_\phi$, $c = 1$ and $A_D$ lies in the $l_r l_\theta$ plane; hence $A_D \perp l_s$, and $\overline{\Psi} = \Psi$ regardless of $\theta$. It follows that when $\nu = 90°$, $\overline{\Psi} = \Psi$ for all values of $\theta$, and hence the right-hand column remains unaltered for all values of $\nu_1$ except $\nu_1 = 90°$.

If $\nu$ and $\nu$ are both 90°, $_3$ lies in the $l_r l_\phi$ plane; and from Equations 75, 76, and 77

$$\sin \overline{\psi} = \frac{|c|\ \sin \theta}{\sqrt{4 \cos^2 \theta + c^2 \sin^2 \theta}} \tag{81}$$

As $l_s$ rotates in the $l_r l_\phi$ plane from the position of $l_\phi$ to that of $l_r$, $c \to 0$ and $\overline{\Psi} \to 0$ regardless of $\theta$ if $\theta \neq 90°$. If $\theta + 90°$ $\sin \overline{\Psi} = 1$, and $\overline{\Psi} = 90°$.

Figure 11:
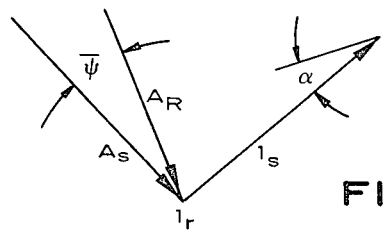
FIG. 11 illustrates a vector relationship from aft the missile.

Now look toward the dipole from behind the missile, the line of sight passing through its center; then the various vectors appear as indicated in FIG. 11, in which $l_r$ is seen as a point. If, now, a torque is applied so that a rotation of the missile axis about the perpendicular vector $A_R$ is produced, the tip of the $l_s$ vector will move in a curve which makes an angle $\alpha$ with $l_{s\,a}$ as indicated. If $l_s$ and $l_r$ do not differ too much in direction $\alpha \approx \Psi$, the apparent length of $l_s$ is a measure of the angle by which the missile is off course. If $\alpha < 90°$, the tip of the $l_s$ vector moves in a spiral and approaches the tip of the $l_r$ vector. The missile is thus brought on course despite the fact that the rotation is about the axis $A_R$ instead of the desired but unknown axis $A_s$.

Figure 12:
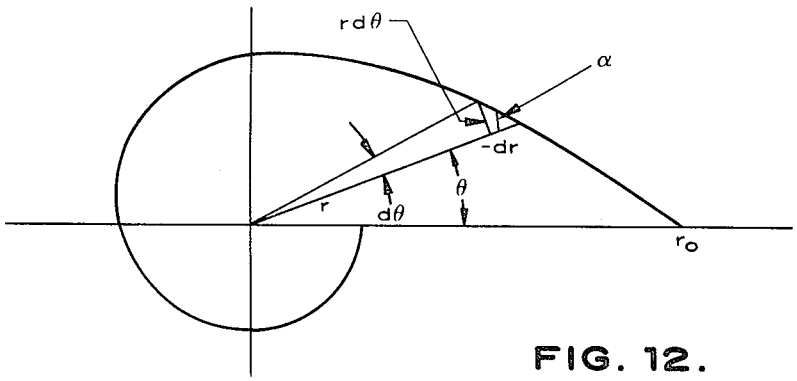
FIG. 12 is a graph in polar coordinates corresponding to FIG. 11.

For purposes fo orientation, consider the problem of finding the curve in plane polar coordinates which makes a constant angle $\alpha < 90°$ with the radius, as indicated in FIG. 12. From the infinitesimal triangle $$\tan \alpha = -\frac{r d\theta}{dr} \tag{82}$$

$$\frac{dr}{r} = -\cot \alpha\, d\theta$$

$$\int_{r_o}^{r} \frac{dr}{r} = -\cot \alpha \int_{o}^{\theta} d\theta$$

$$\ln \frac{r}{r_o} = -\theta \cot \alpha$$

$$r = r_o e^{-\theta \cot \alpha} \tag{83}$$

thus obtaining a logarithmic spiral. The reduction ratio $r/r_o$ for the radius corresponding to one complete rotation is $e_{-2p\cot \alpha}$, values of which for different values of $\alpha$ are given in Table 4.

TABLE 4

| $\alpha$ | Reduction ratio $\frac{(r)\theta = 2\pi}{r_o}$ |
|---|---|
| 0° | 0 |
| 15° | 6.76 · 10 11 |
| 30° | 0.0000191 |
| 45° | 0.00189 |
| 60° | 0.0265 |
| 75° | 0.186 |
| 90° | 1.000 |

Here $r$ plays the role of the projection of $l_s$ and $\theta$ the angle $l_s$ makes with the horizontal as seen in FIG. 11, and $\alpha$ the angle $\overline{\Psi}$. In the actual problem $\overline{\Psi}$ is not constant, the locus of the tip of $l_s$ lies on a unit sphere, and the angle between $l_s$ and $l_r$ may not be small; nevertheless, the situation is the same, and the actual problem can be treated analytically if desired.

CHOICE OF ERROR SIGNALS

It is now possible to apply the results of the preceding section using the $xyz$ coordinate system shown in FIG. 3, in which the $+Az$ direction is forward along the axis of the missile, and the $x$ and $y$ axes are transverse. In view of Equations 1, 46, and 54, $$H = \frac{m}{4\pi r^3} D_H \tag{84}$$

$$\frac{\delta H}{\delta z} = -\frac{\delta H}{\delta s} = \frac{3m}{4\pi r^4} D.$$

Here the minus sign is due to the fact that +the +z direction is forward along the missile axis, whereas $l_s$ in the preceding section points toward the rear along this axis. Equations 55 and 84 now give $$H \times \frac{\delta H}{\delta z} = \frac{3m^2}{16\pi^2 r^7} D_H \times D = \frac{3m^2}{16\pi^2 r^7} A_D \tag{85}$$

$$H \times \frac{\delta H}{\delta z} = \begin{vmatrix} 1_x & 1_y & 1_z \\ H_x & H_y & H_z \\ \frac{\delta H_x}{\delta z} & \frac{\delta H_y}{\delta z} & \frac{\delta H_z}{\delta z} \end{vmatrix} \tag{86}$$

-continued $$= 1_x\left(H_y\frac{\delta H_z}{\delta z} - H_z\frac{\delta H_y}{\delta z}\right)$$

$$+ 1_y\left(H_z\frac{\delta H_x}{\delta z} - H_x\frac{\delta H_z}{\delta z}\right)$$

$$+ 1_z\left(H_x\frac{\delta H_y}{\delta z} - H_y\frac{\delta H_x}{\delta z}\right);$$

hence omitting the axial, or $z$, component in accordance with Equation 67, results in $$\frac{3m^2}{16\pi^2 r^7} A_R = l_x\left(H_y\frac{\delta H_z}{\delta z} - H_z\frac{\delta H_y}{\delta z}\right) + l_y\left(H_z\frac{\delta H_x}{\delta z} - H_x\frac{\delta H_z}{\delta z}\right). \quad (87)$$

Or, solving for $A_R$, $$A_R = \frac{16\pi^2 r^7}{3m^2}\left[l_x\left(H_y\frac{\delta H_z}{\delta z} - H_z\frac{\delta H_y}{\delta z}\right) + l_y\left(H_z\frac{\delta H_x}{\delta z} - H_x\frac{\delta H_z}{\delta z}\right)\right]. \quad (88)$$

Here $A_R$ is a real vector despite the fact that $m$ and the various components of H and $\delta H/\delta z$ are complex. In fact, the direction and sense of $A_R$ are the same as those of the angular velocity vector which is desired to bring the missile axis into ultimate coincidence with the direction of the dipole. It follows that quantities proportional to the $x$ and $y$ components of $A_R$ can be taken as error signals, and that the desired components of angular velocity are proportional to these, respectively. It is noted that when the missile is on course so the error signals vanish, Equation 20 is satisfied.

Although the components of H and $\delta H/\delta z$ are known, $m$ is not known. In view of Equation 1, however, it is known that $Hr^3/m$ is a real vector which is independent of $r$; hence the quantity $$\frac{16\pi^2 r^7}{3m^2}(H_x^2 + H_y^2 + H_z^2) \quad (89)$$

is a real, positive quantity which varies directly with $r$; and Equation 88 may be divided by this quantity without altering the signs or ratios of the components. Thus $$A_R^* = \frac{3m^2 A_R}{16\pi^2 r^7 (H_x^2 + H_y^2 + H_z^2)} = \frac{l_x\left(H_y\frac{\delta H_z}{\delta z} - H_z\frac{\delta H_y}{\delta z}\right) + l_y\left(H_z\frac{\delta H_x}{\delta z} - H_x\frac{\delta H_z}{\delta z}\right)}{H_x^2 + H_y^2 + H_z^2} \quad (90)$$

which may replace $A_R$, since it has the same direction and sense. The $x$ and $y$ components of $A_R^*$ can be taken as error signals, the corresponding desired components of angular velocity being proportional to these.

$A_R^*$ is more useful than $A_R$. The unknown quantity $m$ no longer appears; and since $A_R^*$ varies only inversely as $r$, the dependence on $r$ is rather weak, and can be taken care of by some system of automatic gain control.

In order to apply Equation 90, it is necessary to obtain the components of H and dH/dz, all of which are complex. If the magnetic field were due to a complex dipole with an axis and hence postulated in deriving Equation 90, these components would all have the same (or opposite) phase, and hence lie along a line in the complex plane. It follows that a suitable choice of the time origin would make them all real. This is equivalent to choosing the phase of any one of these components as being that corresponding to angle zero in the complex plane.

Aside from the work involved in determining the components of H and $\delta H/\delta z$ in Equation 90, there is, however, a more subtle difficulty. The analytical work begun in the section, on the calculation of $\delta g \delta H$ $s\delta H$ and continued to this point pertained to a complex dipole having an axis. Actually, however, the field is that due to an alternating dipole of the most general type, consists of two fields of the type under consideration. Neglect of this fact as a "simplifying assumption" would introduce errors, and is not necessary or desirable.

The complex vector moment of the alternating dipole may be written in the form of Equation 3, thus $$\vec{m} = \vec{m_1} + j\vec{m_2} \quad (3)$$

wherein $\vec{m_1}$ and $\vec{m_2}$ are real vectors. Both $\vec{m_1}$ and $j\vec{m_2}$ have axes; and each produces a field of the type treated above. Equation 90 would hence be valid if applied to either of these fields acting alone. With both acting together, however, each of the various components of H and $\delta H/\delta z$ is composed of two parts — a real part due to $\vec{m_1}$, and an imaginary part due to $j\vec{m_2}$, thus $$H_x = H_{x1} + jH_{x2},\ H_y = H_{y1} + jH_{y2},\ H_z = H_{z1} + jH_{z2}, \quad (91)$$

$$\frac{\delta H_x}{\delta z} = \frac{\delta H_{x1}}{\delta z} + j\frac{\delta H_{x2}}{\delta z},$$

$$\frac{\delta H_y}{\delta z} = \frac{\delta H_{y1}}{\delta z} + j\frac{\delta H_{y2}}{\delta z},$$

$$\frac{\delta H_z}{\delta z} = \frac{\delta H_{z1}}{\delta z} + j\frac{\delta H_{z2}}{\delta z};$$

and $A_R^*$ becomes $$A_R^* = \left\{l_x\left[(H_{y1} + jH_{y2})\left(\frac{\delta H_{z1}}{\delta z} + j\frac{\delta H_{z2}}{\delta z}\right) - (H_{z1} + jH_{z2})\left(\frac{\delta H_{y1}}{\delta z} + j\frac{\delta H_{y2}}{\delta z}\right)\right] + l_y\left[(H_{z1} + jH_{z2})\left(\frac{\delta H_{x1}}{\delta z} + j\frac{\delta H_{x2}}{\delta z}\right) - (H_{x1} + jH_{x2})\left(\frac{\delta H_{z1}}{\delta z} + j\frac{\delta H_{z2}}{\delta z}\right)\right]\right\} \div [(H_{x1} + jH_{x2})^2 + (H_{y1} + jH_{y2})^2 + (H_{z1} + jH_{z2})^2]. \quad (92)$$

Very likely this expression has a nonvanishing imaginary part; and although it is possible that the real part is a vector which is a satisfactory combination of those given by $\vec{m}_1$ and $j\vec{m}_2$ acting alone, it is far from evident that this is the case.

Using instantaneous values and denoting the value of $A_R$ due to the field of $\vec{m}_1$ acting alone by $A_{R1}$, from Equation 87

$$\frac{3m_1^2}{16\pi^2 r^7} A_{R1} = l_x\left(H_{y1}\frac{\delta H_{z1}}{\delta z} - H_{z1}\frac{\delta H_{y1}}{\delta z}\right) + l_y\left(H_{z1}\frac{\delta H_{x1}}{\delta z} - H_{x1}\frac{\delta H_{z1}}{\delta z}\right) \tag{93}$$

where $m_1 = |\vec{m}_1|$. Similarly, the value of $A_R$ due to the field of $jm_2$ acting alone is given by $$\frac{3(jm_2)^2}{16\pi^2 r^7} A_{R2} = l_x\left(jH_{y2}j\frac{\delta H_{z2}}{\delta z} - jH_{z2}j\frac{\delta H_{y2}}{\delta z}\right) + l_y\left(jH_{z2}j\frac{\delta H_{x2}}{\delta z} - jH_{x2}j\frac{\delta H_{z2}}{\delta z}\right),$$

or $$\frac{3m_2^2}{16\pi^2 r^7} A_{R2} = l_x\left(H_{y2}\frac{\delta H_{z2}}{\delta z} - H_{z2}\frac{\delta H_{y2}}{\delta z}\right) + l_y\left(H_{z2}\frac{\delta H_{x2}}{\delta z} - H_{x2}\frac{\delta H_{z2}}{\delta z}\right) \tag{94}$$

where $m_2 = |\vec{m}_2|$.

With both $\vec{m}_1$ and $j\vec{m}_2$ acting, from Equation 101 the instantaneous values of the components of H and $\delta H/\delta z$, indicated by the additional subscript I, are[1]

$$H_{xI} = \sqrt{2}\,(H_{x1}\sin\omega + H_{x2}\cos\omega t)$$

$$H_{yI} = \sqrt{2}(H_{y1}\sin\omega + H_{y2}\cos\omega t)$$

$$H_{zI} = \sqrt{2}(H_{z1}\sin\omega t + H_{z2}\cos\omega t) \tag{95}$$

$$\frac{\delta H_{xI}}{\delta z} = \sqrt{2}\left(\frac{\delta H_{x1}'}{\delta z}\sin\omega t + \frac{\delta H_{x2}}{\delta z}\cos\omega t\right)$$

$$\frac{\delta H_{yI}}{\delta z} = \sqrt{2}\left(\frac{\delta H_{y1}}{\delta z}\sin\omega t + \frac{\delta H_{y2}}{\delta z}\cos\omega t\right)$$

-continued $$\frac{\delta H_{zI}}{\delta z} = \sqrt{2}\left(\frac{\delta H_{z1}}{\delta z}\sin\omega t + \frac{\delta H_{z2}}{\delta z}\cos\omega t\right).$$

[1]The complex notation used here is such that the complex number A $\angle\theta$ corresponds to the sinusoid A $\sqrt{2}\sin(\omega t + \theta)$ regardless of $\omega$. It follows that the complex number $(a + jb)$ corresponds to the sinusoid $(a\sqrt{2}\sin\omega t + b\sqrt{2}\cos\omega t)$.

If, now, the various quantities on the right-hand side of Equation 87 are replaced by their instantaneous valves, $$\begin{aligned} & l_x\left(H_{yI}\frac{\delta H_{zI}}{\delta z} - H_{zI}\frac{\delta H_{yI}}{\delta z}\right) + l_y\left(H_{zI}\frac{\delta H_{xI}}{\delta z} - H_{xI}\frac{\delta H_{zI}}{\delta z}\right) \\ &= 2l_x\left[(H_{y1}\sin\omega t + H_{y2}\cos\omega t)\left(\frac{\delta H_{z1}}{\delta z}\sin\omega t + \frac{\delta H_{z2}}{\delta z}\cos\omega t\right)\right. \\ &\quad \left. - (H_{z1}\sin\omega t + H_{z2}\cos\omega t)\times\left(\frac{\delta H_{y1}}{\delta z}\sin\omega t + \frac{\delta H_{y2}}{\delta z}\cos\omega t\right)\right] \\ &\quad + 2l_y\left[H_{z1}\sin\omega t + H_{z2}\cos\omega t)\left(\frac{\delta H_{x1}}{\delta z}\sin\omega t + \frac{\delta H_{x2}}{\delta z}\cos\omega t\right)\right. \\ &\quad \left. - (H_{x1}\sin\omega t + H_{x2}\cos\omega t)\times\left(\frac{\delta H_{z1}}{\delta z}\sin\omega t + \frac{\delta H_{z2}}{\delta z}\cos\omega t\right)\right] \end{aligned} \tag{96}$$

Carrying out the multiplications and noting that $$\sin^2\omega t = \tfrac{1}{2}(l - \cos 2\omega t),$$

$$\cos^2\omega t = \tfrac{1}{2}(l + \cos 2\omega t),$$

$$\omega t\cos\omega t = \tfrac{1}{2}\sin 2\omega t,$$

It follows that $$\begin{aligned} & l_x\left(H_{yI}\frac{\delta H_{zI}}{\delta z} - H_{zI}\frac{\delta H_{yI}}{\delta z}\right) + l_y\left(H_{zI}\frac{\delta H_{xI}}{\delta z} - H_{xI}\frac{\delta H_{zI}}{\delta z}\right) \\ &= l_x\left(H_{y1}\frac{\delta H_{z1}}{\delta z} - H_{z1}\frac{\delta H_{y1}}{\delta z}\right) + l_y\left(H_{z1}\frac{\delta H_{x1}}{\delta z} - H_{x1}\frac{\delta H_{z1}}{\delta z}\right) \\ &\quad + l_x\left(H_{y2}\frac{\delta H_{z2}}{\delta z} - H_{z2}\frac{\delta H_{y2}}{\delta z}\right) + l_y\left(H_{z2}\frac{\delta H_{x2}}{\delta x} - H_{x2}\frac{\delta H_{z2}}{\delta z}\right) \\ &\quad + \text{terms of angular frequency } 2\omega. \end{aligned} \tag{98}$$

Substituting from Equations 93 and 94, this becomes $$l_x\left(H_{yI}\frac{\delta H_{zI}}{\delta z} - H_{zI}\frac{\delta H_{yI}}{\delta z}\right) + \tag{99}$$

-continued $$l_y\left(H_{zI}\frac{\delta H_{zI}}{\delta z} - H_{xI}\frac{\delta H_{zI}}{\delta z}\right)$$

$$= \frac{3}{16\pi^2 r^7}(m_1^2 A_{R1} + m_2^2 A_{R2}) +$$

terms of angular frequency $2\omega$.

If the AC (double frequency) component is filtered out of the error signals, only the DC, or constant, component is retained, this becomes simply $$S = \frac{3}{16\pi^2 r^7}(m_1^2 A_{R1} + m_2^2 A_{R2}) \tag{100}$$

Figure 13:
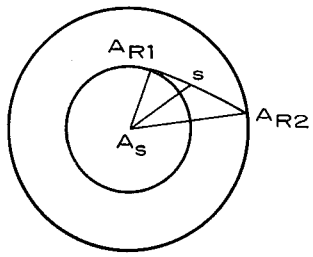
FIG. 13 illustrates the relationship between $A_{R1}$, $A_{R2}$ and $A_s$.

The direction of the vector $m_1^2 A_{R1} + m_2^2 A_{R2}$ lies between that of $A_{R1}$ and that of $A_{R2}$ in the plane of these two vectors; also because of $m_1^2$ and $m_2^2$, the term resulting from the stronger dipole tends greatly to be favored, although the orientation of the dipoles is also a factor. In any case the direction of S in Equation 100 is a better approximation to the desired direction — that of $A_s$ — than is that of the least favorable of the two vector approximations $A_{R1}$ and $A_{R2}$. This is evident from FIG. 13, which is looking in the direction opposite to that of $A_s$. Let the angles between $A_{r1}$ and $A_s$, and between $A_{R2}$ and $A_s$ be specified — and assume that the latter angle is the larger; then $A_{R1}$ and $A_{R2}$ lie on two cones which have $A_s$ as a common axis, and the two angles as the half vertex angles, respectively. These cones are indicated in FIG. 13 by the circles, which are the curves of intersection of the cones with a unit sphere whose center is the common vertex of the cones. The vector s in Equation 100 starts at this vertex, and passes through some point on that great circle on the unit sphere which passes through $A_{R1}$ and $A_{R2}$. On that circle s lies between $A_{R1}$ and $A_{R2}$. Regardless of the positions of $A_{R1}$ and $A_{R2}$ on their cones, s approximates $A_s$ better in direction than does $A_{R2}$. Thus the direction for the angular velocity vector that is obtained by taking as error signals the DC components of the x and y components of the vector $$l_x\left(H_{yI}\frac{\delta H_{zI}}{\delta z} - H_{zI}\frac{\delta H_{yI}}{\delta z}\right) + l_y\left(H_{zI}\frac{\delta H_{xI}}{\delta z} - H_{xI}\frac{\delta H_{zI}}{\delta z}\right) \tag{101}$$

is at least as good an approximation to the desired direction of $A_s$ as is that of the poorer of the two approximations $A_{R1}$ and $A_{R2}$.

Finally, note from Equation 100 that the signal s varies inversely as $r^7$. This can, perhaps, be taken care of by some system of automatic gain control. If, however, difficulty is encountered due to the great range of variation involved, the situation can be greatly alleviated by dividing the above error signals, given by Equation 101, by the DC components of $$H_{xI}^2 + H_{yI}^2 + H_{zI}^2 \tag{102}$$

which varies inversely as $r^6$, and is used merely as a normalizing factor. This follows from the fact that $$\begin{aligned} H_{xI}^2 + H_{yI}^2 + H_{zI}^2 &= 2\,[(H_{x1}\sin\omega t + H_{x2}\cos\omega t)^2 \\ &+ (H_{y1}\sin\omega t + H_{y2}\cos\omega t)^2 + (H_{z1}\sin\omega t \\ &+ H_{z2}\cos\omega t)^2] \\ &= (H_{x1}^2 + H_{y1}^2 + H_{z1}^2 + H_{x2}^2 + H_{y2}^2 + H_{z2}^2) \end{aligned} \tag{103}$$

-continued $$+ \text{ terms of angular frequency } 2\omega\ H_{xI}^2 + H_{yI}^2$$

$$+ H_{zI}^2 = |H_1|^2 + |H_2|^2$$

$$+ \text{ terms of angular frequency } 2\omega$$

due to Equations 95 and 97. The quantity used in dividing is hence the sum of the squares of the absolute values of the two real vectors $H_1$ and $H_2$. Since the resulting quotient varies inversely as $r$ instead of $r^7$, the $r$ variation has been very greatly reduced by the division, and should cause no difficulty.

CALCULATION OF ERROR SIGNALS

Once the decision has been made as to which analytic expressions to use for the error signals, it would be desirable to calculate how large these signals are in certain situations which are similar to those encountered in practice. Such data could be used to indicate the feasibility and required sensitivity of any proposed electronic and servo system that is to be operated by these signals. For such preliminary calculations, it would be sufficient to consider an alternating dipole with an axis (a single dipole) to be the source of the magnetic field.

Figure 14A:
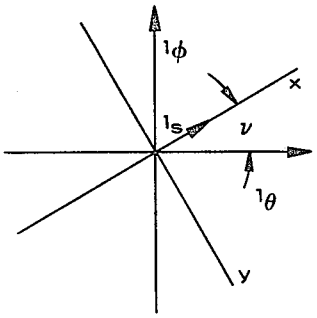
FIGS. 14*a* and 14*b* illustrate, graphically, particular orientations of a dipole.
Figure 14B:
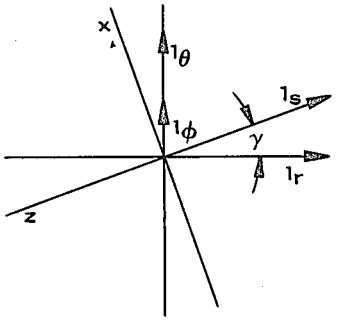

For any specified dipole the data on H and $\delta H/\delta s$ which is available from Equations 1 and 45 is expressed in terms of components in the $l_r$, $l_\theta$, and $l_\phi$ directions. In order to use this data for computing the error signals, however, it must first be transformed so as to obtain $H_x$, $H_y$, $H_z$, $\delta H_x/\delta z$, $\delta H_y/\delta z$, and $\delta H_z/\delta z$, where, as in the preceding section, the $x$, $y$, and $z$ axes are fixed in the missile, as shown in FIG. 3. The $+z$ axis necessarily extends in the direction opposite to that of the vector $l_s$; however, the $A_R$ vector is independent of the orientation of the $x$ and $y$ axes. Therefore, whatever orientation is most convenient may be chosen. Accordingly, choose that shown in FIG. 14. The $l_r$, $l_\theta$, and $l_\phi$ axes and the $x$, $y$, and $z$ axes have a common origin; the angle between the $-z$ *axis* ($l_s$) and the $l_r$ axis will be denoted by $\gamma$, and $\nu$ has the same meaning which was given to it by the definition Equation 64 — it is the apparent angle of slope of $l_s$ ($-z$ axis) when viewed in the $-l_r$ direction. $\gamma$ and $\nu$ together specify the position of the $z$ axis. For convenience the $x$ and $y$ axes are chosen so that the $y$ axis is the line of intersection of the two planes which are normal, respectively, to $l_r$ and the $z$ axis at the origin; and the $+x$ direction appears to coincide with that of $l_s$ ($-z$ axis) when the axes are viewed in the $-l_r$ direction, as shown in FIGS. 14*a* and 14*b*.

In order to obtain the $x$, $y$, and $z$ components of H, note that $$H = l_x H_x + l_y H_y + l_z H_z = l_r H_r + l_\theta H_\theta + l_\phi H_\phi \tag{104}$$

Forming the dot products of this equation and $l_x$, $l_y$, and $l_z$, respectively, noting the orthogonality of the unit vectors, results in $$\begin{aligned} H_x &= l_x \cdot l_r H_r + l_x \cdot l_\theta H_\theta + l_x \cdot l_\phi H_\phi, \\ H_y &= l_y \cdot l_r H_r + l_y \cdot l_\theta H_\theta + l_y \cdot l_\phi H_\phi, \\ H_z &= l_z \cdot l_r H_r + l_z \cdot l_\theta H_\theta + l_z \cdot l_\phi H_\phi. \end{aligned} \tag{105}$$

Since the dot product of two unit vectors is merely the cosine of the angle between them, the coefficients of the H components in Equation 105 consist of the direction cosines of the two sets of axes. These can be written down by inspection of FIGS. 14*a* and 14*b* and are contained in Table 5 .

TABLE 5.

| | Direction Cosines | | |
|---|---|---|---|
| | $l_r$ | $l_\theta$ | $l_\phi$ |
| $l_x$ | $-\sin\gamma$ | $\cos\gamma\cos\nu$ | $\cos\gamma\sin\nu$ |
| $l_y$ | O | $\sin\nu$ | $-\cos\nu$ |
| $l_z$ | $-\cos\gamma$ | $-\sin\gamma\cos\nu$ | $-\sin\gamma\sin\nu$ |

Substituting these values in Equations 115 gives $$H_x = -H_r\sin\gamma + H_\theta\cos\gamma\cos\nu + H_\phi\cos\gamma\sin\nu$$

$$H_y = H_\theta\sin\nu - H_\phi\cos\nu$$

$$H_z = -H_r\cos\gamma - H_\theta\sin\gamma\cos\nu - H_\phi\sin\gamma\sin\nu \quad ; \tag{106}$$

hence substituting the expressions for $H_r$, $H_\theta$, and $H_\phi$ taken from Equation 1, results in $$H_x = \frac{m}{4\pi r^3}(-2\cos\theta\sin\gamma + \sin\theta\cos\gamma\cos\nu) \tag{107}$$

$$H_y = \frac{m}{4\pi r^3}\sin\theta\sin\nu$$

$$H_z = \frac{m}{4\pi r^3}(-2\cos\theta\cos\gamma - \sin\theta\sin\gamma\cos\nu).$$

Turning next to the calculation of the components of $\delta H/\delta z$, denote the components of $\delta H/\delta z$ along the $l_r$, $l_\theta$, and $l_\phi$ axes by $(\delta H/\delta z)_r$, $(\delta H/\delta z)_\theta$, and $(\delta H/\delta z)_\phi$, respectively. The *x*, *y*, and *z* components of $\delta H/\delta z$ are $\delta H_x\delta z$, $\delta H_y/\delta z$, and $\delta H_z/\delta z$, from Equation 104 and the fact that the unit vectors $l_x$, $l_y$, and $l_z$ are constant. It is not true, however, that $(\delta H/\delta z)_r$ is $\delta H_r/\delta z$, for $l_r$ is not constant.

Noting Equation 104, it is seen that $$\frac{\delta H}{\delta z} = l_x\frac{\delta H_x}{\delta z} + l_y\frac{\delta H_y}{\delta z} + l_z\frac{\delta H_z}{\delta z} = l_r\left(\frac{\delta H}{\delta z}\right)_r + l_\theta\left(\frac{\delta H}{\delta z}\right)_\theta 1 + 1_\phi\left(\frac{\delta H}{\delta z}\right)_\phi \tag{108}$$

Multiplying by $l_x$, $l_y$, and $l_z$ as with Equation 114, gives $$\frac{\delta H_x}{\delta z} = l_x\cdot l_r\left(\frac{\delta H}{\delta z}\right)_r + l_x\cdot l_\theta\left(\frac{\delta H}{\delta z}\right)_\theta + l_x\cdot l_\phi\left(\frac{\delta H}{\delta z}\right)_\phi, \tag{109}$$

$$\frac{\delta H_y}{\delta z} = l_y\cdot l_r\left(\frac{\delta H}{\delta z}\right)_r + l_y\cdot l_\theta\left(\frac{\delta H}{\delta z}\right)_\theta + l_y\cdot l_\phi\left(\frac{\delta H}{\delta z}\right)_\phi,$$

$$\frac{\delta H_z}{\delta z} = l_z\cdot l_r\left(\frac{\delta H}{\delta z}\right)_r + l_z\cdot l_\theta\left(\frac{\delta H}{\delta z}\right)_\theta +$$

-continued $$l_z\cdot l_\phi\left(\frac{\delta H}{\delta z}\right)_\phi;$$

in which it is noted that the coefficients are the same as those in Equation 105, namely, the direction cosines. Substituting from Table 5, these equations become $$\frac{\delta H_x}{\delta z} = -\left(\frac{\delta H}{\delta z}\right)_r\sin\gamma + \left(\frac{\delta H}{\delta z}\right)_\theta\cos\gamma\cos\nu + \left(\frac{\delta H}{\delta z}\right)_\phi\cos\gamma\sin\nu; \tag{110}$$

$$\frac{\delta H_y}{\delta z} = \left(\frac{\delta H}{\delta z}\right)_\theta\sin\nu - \left(\frac{\delta H}{\delta z}\right)_\phi\cos\nu;$$

$$\frac{\delta H_z}{\delta z} = -\left(\frac{\delta H}{\delta z}\right)_r\cos\gamma - \left(\frac{\delta H}{\delta z}\right)_\theta\sin\gamma\cos\nu - \left(\frac{\delta H}{\delta z}\right)_\phi\sin\gamma\sin\nu \tag{111}$$

Since $$\frac{\delta H}{\delta z} = -\frac{\delta H}{\delta s}$$

the *r*, $\theta$, and $\phi$ components of $\delta H/\delta z$ are the negatives of those for $\delta H/\delta s$; and can hence be taken directly from Equation 45, in which *a*, *b*, and *c* are the negatives of the direction cosines of the $+z$ axis, thus $$a = \cos\gamma,\ b = \sin\gamma\cos\nu,\ c = \sin\gamma\sin\nu. \tag{112}$$

Inserting the values so obtained in Equation 120, results in $$\frac{\delta H_x}{\delta z} = \frac{3m}{4\pi r^4}[-\sin\gamma(2\cos\gamma\cos\theta + \sin\gamma\cos\nu\sin\theta) + \cos\gamma\cos\nu(\cos\gamma\sin\theta - \sin\gamma\cos\nu\cos\theta) - \cos\gamma\sin\nu\sin\gamma\sin\nu\cos\theta], \tag{113}$$

$$\frac{\delta H_y}{\delta z} = \frac{3m}{4\pi r^4}[\sin\nu(\cos\gamma\sin\theta - \sin\gamma\cos\nu\cos\theta) + \cos\nu\sin\gamma\sin\nu\cos\theta],$$

$$\frac{\delta H_z}{\delta z} = \frac{3m}{4\pi r^4}[-\cos\gamma(2\cos\gamma\cos\theta + \sin\gamma\cos\nu\sin\theta) - \sin\gamma\cos\nu(\cos\gamma\sin\theta - \sin\gamma\cos\nu\cos\theta) + \sin\gamma\sin\nu\sin\gamma\sin\nu\cos\theta];$$

or, collecting terms, $$\frac{\delta H_x}{\delta z} = \frac{3m}{4\pi r^4}[\sin\theta\cos\nu(2\cos^2\gamma - 1) - 3\cos\theta\sin\gamma\cos\gamma] \tag{114}$$

$$\frac{\delta H_y}{\delta z} = \frac{3m}{4\pi r^4}\sin\theta\sin\nu\cos\gamma,$$

$$\frac{\delta H_z}{\delta z} = \frac{3m}{4\pi r^4}[-2\sin\theta\cos\nu\sin\gamma\cos\gamma + \cos\theta(1 - \cos^2\gamma)]$$

Now expressions 107 and 114 for the *x*, *y*, and *z* components of H and H/*z*, these can be used to obtain the following quantities, which give the error signals.

$$H_y\frac{\delta H_z}{\delta z} - H_z\frac{\delta H_y}{\delta z} = \frac{3m^2}{16\pi^2R^7}\{\sin\theta\sin\nu[-2\sin\theta\cos\nu\sin\gamma\cos\gamma + \cos\theta(1-3\cos^2\gamma)] - (-2\cos\theta\cos\gamma - \sin\theta\sin\gamma\cos\nu)\sin\theta\sin\nu\cos\gamma\} = \frac{3m^2}{16\pi^2r^7}\sin\theta\sin\nu[-\sin\theta\cos\nu\sin\gamma\cos\gamma + \cos\theta(1-\cos^2\gamma)]; \tag{115}$$

$$H_z\frac{\delta H_x}{\delta z} - H_x\frac{\delta H_z}{\delta z} = \frac{3m^2}{16\pi^2r^7}\{(-2\cos\theta\cos\gamma - \sin\theta\sin\gamma\cos\nu)[\sin\theta\cos\nu(2\cos^2\gamma-1) - 3\cos\theta\sin\gamma\cos\gamma] - (-2\cos\theta\sin\gamma + \sin\theta\cos\gamma\cos\nu)[-2\sin\theta\cos\nu\sin\gamma\cos\gamma + \cos\theta(1-3\cos^2\gamma)]\} = \frac{3m^2}{16\pi^2r^7}\{\sin^2\theta[-\sin\gamma\cos^2\nu(2\cos^2\gamma-1) + 2\cos 2\nu\sin\gamma\cos^2\gamma] + \sin\theta\cos\theta[-2\cos\nu\times\cos\gamma(2\cos^2\gamma-1) + 3\cos\nu\sin^2\gamma\cos\gamma - 4\cos\nu\sin^2\gamma\cos\gamma - \cos\nu\cos\gamma(1-3\cos^2\gamma)] + \cos^2\theta[6\sin\gamma\cos^2\gamma + 2\sin\gamma(1-3\cos^2\gamma)]\}.$$

Collecting terms results in $$H_y\frac{\delta H_z}{\delta z} - H_z\frac{\delta H_y}{\delta z} = \frac{3m^2}{16\pi^2r^7}\sin\theta\sin\nu\sin\gamma(\cos\theta\sin\gamma - \sin\theta\cos\nu\cos\gamma), \tag{116}$$

$$H_z\frac{\delta H_x}{\delta z} - H_x\frac{\delta H_z}{\delta z} = \frac{3m^2}{16\pi^2r^7}\sin\gamma(\sin^2\theta\cos^2\nu + 2\cos^2\theta).$$

Figure 15:
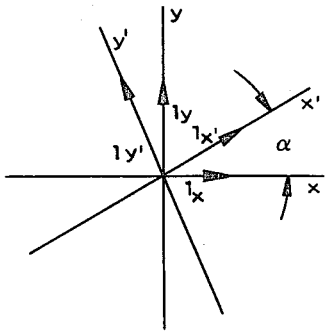
FIG. 15 illustrates, graphically, a differently oriented set of $x$ and $y$ axes.

If $m$ be replaced by $m_1$ or $m_2$, Equation 116 can be used to give the quantities $$S_{x1} = H_{y1}\frac{\delta H_{z1}}{\delta z} - H_{z1}\frac{\delta H_{y1}}{\delta z} \text{ and} \tag{117}$$

$$S_{y1} = H_{z1}\frac{\delta H_{x1}}{\delta z} - H_{x1}\frac{\delta H_{z1}}{\delta z};$$

or $$S_{x2} = H_{y2}\frac{\delta H_{z2}}{\delta z} - H_{z2}\frac{\delta H_{y2}}{\delta z} \text{ and} \tag{118}$$

$$S_{y2} = H_{z2}\frac{\delta H_{x2}}{\delta z} - H_{x2}\frac{\delta H_{z2}}{\delta z},$$

respectively, which appear in Equations 93, 94, and 98. In so doing, however, it should be remembered that $\theta$, $\nu$, and the $xy$ axes used in connection with $m_1$ are in general not the same as those used with $m_2$. Since $S_{x1}$ and $S_{y1}$ are the $x$ and $y$ components, respectively, of the vector $$S_1 = \frac{3m_1^2}{16\pi^2r^7}A_{R1} \tag{119}$$

as is evident from Equation 93; and since $A_{R1}$ is independent of the orientation of the $xy$ axes, the error signals $S_{x'1}$ and $S_{y'1}$ corresponding to a differently oriented set of $xy$ axes, denoted by $x'$ and $y'$ as indicated in FIG. 15, can be obtained from the relation $$S_1 = l_{x'}\cdot S_{x'1} + l_{y'}\cdot S_{y'1} = l_x\cdot S_{x1} + l_y\cdot S_{y1} \tag{120}$$

where $l_{x'}$ and $l_{y'}$ are unit vectors along the x' and y' axes, respectively. Multiplying by $l_{x'}$ and $l_{y'}$ gives $$S_{x'1} = l_{x'}\cdot l_x S_{x1} + l_{x'}\cdot l_y S_{y1},$$

$$S_{y'1} = l_{y'}\cdot l_x S_{x1} + l_{y'}\cdot l_y S_{y1}; \tag{121}$$

or, noting FIG. 15.

$$S_{x'1} = S_{x1}\cos\alpha + S_{y1}\sin\alpha,$$

$$S_{y'1} = -S_{x1}\sin\alpha + S_{y1}\cos\alpha. \tag{122}$$

Similar relations pertain to $m_2$ and the corresponding error signals $S_{x'2}$ and $S_{y'2}$. It is thus evident that no difficulty would be encountered in getting the error signals due to $m_1$ and $m_2$ together for any specified set of $x'y'$ axes. For present purposes one can omit $m_2$ and consider the magnetic field to be due to $m_1$ alone.

Finally, in connection with the normalizing factor (Equation 103), from Equation 1 that for a complex dipole $m$ having an axis, $|H|$ is given by $$|H| = \frac{m}{4\pi r^3}\sqrt{4\cos^2\theta + \sin^2\theta} \tag{123}$$

$$|H| = \frac{m}{4\pi r^3}\sqrt{1 + 3\cos^2\theta}.$$

Replacing $m$ by $m_1$ and squaring, this expression can be used to give $|H_1|^2$, thus $$|H_1|^2 = \frac{m_1^2}{16\pi^2r^6}(1 + 3\cos^2\theta) \tag{124}$$

where $\theta$ is the polar angle for $m_1$.

Similarly, for the field due to $m_2$ (in cases wherein $m_2 \neq 0$), $$|H_2|^2 = \frac{m_2^2}{16\pi^2r^6}(1 + 3\cos^2\theta) \tag{125}$$

where $\theta$ pertains to $m_2$.

FEASIBILITY OF THE USE OF GRADIENT CURVES FOR GUIDANCE

In the guidance scheme just considered, it was assumed that the only data which are available are H and $\delta H/\delta z$, this restriction being due to the assumption that sensors are placed only in the front and rear of the missile. If the lateral dimensions of the missile, such as wingspread, are such that additional sensors can be placed laterally, it becomes possible to obtain $\delta H/\delta x$ and $\delta H/\delta y$; in addition to $\delta H/\delta z$; hence the gradient of the magnitude of the magnetic field intensity vector can be determined. As a magnetic dipole is approached, the strength of the magnetic field increases; therefore, the curves along which the field strength increases at the greatest rate would be suitable trajectories, and could be used to guide the missile.

Consider a dipole of complex magnetic moment $m$ and having an axis. It is hence not of the most general type. The complex magnetic field intensity vector is then given by Equation 1, thus $$H = \frac{m}{4\pi r^3}(l_r 2\cos\theta + l_\theta\sin\theta); \tag{126}$$

and the corresponding instantaneous value of the magnetic field intensity vector is $$H_I = \frac{m_o\sqrt{2}}{4\pi r^3}(l_r 2\cos\theta + l_\theta \sin\theta)\sin(\omega t + \alpha) \tag{127}$$

where $m_o$ and $\alpha$ are taken from the relation $$\vec{m} = l_d(m_o < \alpha) \tag{128}$$

which gives the detailed specification of the complex dipole. The square of the absolute value of $H_I$ is $$H_I^2 = \frac{m_o^7}{8\pi^2 r^6} 84\cos^2\theta + \sin^2\theta)\sin^2(\omega t + \alpha) \tag{129}$$

or $$H_I^2 = \frac{m_o^2}{16\pi^2 r^6}(1 + 3\cos^2\theta)[1 - \cos(2\omega t + 2\alpha)]. \tag{130}$$

Noting that in spherical coordinates $(r, \theta, \phi)$, *which are shown in FIG. 1, the gradient of a scalar function* $f$ is $$\nabla f = l_r\frac{\delta f}{\delta r} + 1_\theta\frac{1}{r}\frac{\delta f}{\delta\theta} + 1_\phi\frac{1}{r\sin\theta}\frac{\delta f}{\delta\phi}, \tag{131}$$

and from Equation 140

$$\nabla H_I^2 = \frac{m_o^2}{16\pi^2}\left[-l_r\frac{6}{r^7}(1 + 3\cos^2\theta) - 1_\theta\frac{6}{r^7}\cos\theta\sin\theta\right]\times[1 - \cos(2\omega t + 2\alpha)]$$

$$\nabla H_I^2 = -\frac{3m_o^2}{8\pi^2 r^7}[l_r(1 + 3\cos^2\theta) + 1_\theta\sin\theta\cos\theta] \times [1 - \cos(2\omega t + 2\alpha)]. \tag{132}$$

This vector points in the direction in which the field strength is increasing at the greatest rate. Since this direction is not that of $(-l_r)$, it differs from that toward the dipole. If, however, $\beta$ is denoted the angle which it makes with that toward the dipole, it is evident from Equation 132 that $$\tan\beta = \frac{\sin\theta\cos\theta}{1 + 3\cos^2\theta} = \frac{\sin 2\theta}{5 + 3\cos 2\theta} \tag{133}$$

which expression is independent of time. Values of $\beta$ obtained from this relation are contained in Table 6. It was found by differentiation of Equation 133 that the greatest value of $\beta$ is $\tan^{-1}\frac{1}{4} = 14°2'$, which is obtained when $\theta = \tan^{-1}2 = 63°26'$.

TABLE 6.

| $\theta$ | Values of $\beta$ $\tan\beta$ | $\beta$ |
|---|---|---|
| 0° | 0 | 0 |
| 15° | 0.0659 | 3° 46′ |
| 30° | 0.1333 | 7° 36′ |
| 45° | 0.200 | 11° 19′ |
| 60° | 0.248 | 13° 56′ |
| 75° | 0.208 | 11° 45′ |
| 90° | 0 | 0 |

Refer to those curves which at all points are tangent to $\nabla H_I^2$, and hence to $\nabla|H_I|$, as "gradient curves." These curves are at all points tangent to the direction in which the strength of the magnetic field is increasing at the greatest rate. In the present case they are stationary, since the field does not change shape during the course of a cycle. In view of the data just obtained it is evident that the gradient curves nowhere deviate by more than 14°2′ from the direction toward the dipole. They are thus entirely adequate for guidance purposes; in fact they are very good.

In the situation when the alternating dipole is of the most general type and has no single axis, the complex dipole moment is given by Equation 3, thus again $$\vec{m} = \vec{m}_1 + j\vec{m}_2 \tag{3}$$

where $\vec{m}_1$ and $\vec{m}_2$ are real vectors; and the complex components of H and $\delta H/\delta z$ are given by Equation 91, with similar relations pertaining to the components of $\delta H/\delta x$ and $\delta H/\delta y$. The instantaneous values of the components of magnetic field intensity and their derivatives with respect to $z$ are given by Equation 95, with similar relations pertaining to the derivatives with respect to $x$ and $y$. As usual, the xyz axes are fixed with the missile, as indicated in FIG. 3.

Noting Equation 95, the instantaneous value of the square of the magnetic field intensity is given by $$\begin{aligned} H_I^2 &= H_{xI}^2 + H_{yI}^2 + H_{zI}^2 = 2(H_{x1}\sin\omega t + H_{x2}\cos\omega t)^2 \\ &+ 2(H_{y1}\sin\omega t + H_{y2}\cos\omega t)^2 + 2(H_{z1}\sin\omega t \\ &+ H_{z2}\cos\omega t)^2 = 2[(H_{x1}^2 + H_{y1}^2 + H_{z1}^2)\sin^2\omega t \\ &+ (H_{x2}^2 + H_{y2}^2 + H_{z2}^2)\cos^2\omega t + 2(H_{x1}H_{x2} + H_{y1}H_{y2} \\ &+ H_{z1}H_{z2})\sin\omega t\cos\omega t] \end{aligned} \tag{134}$$

$$\begin{aligned} H_I^2 &= (H_{x1}^2 + H_{y1}^2 + H_{z1}^2)(1 - \cos 2\omega t) \\ &+ (H_{x2}^2 + H_{y2}^2 + H_{z2}^2)(1 + \cos 2\omega t) \\ &+ 2(H_{x1}H_{x2} + H_{y1}H_{y2} + H_{z1}H_{z2})\sin 2\omega t. \end{aligned} \tag{135}$$

If follows that $$\begin{aligned} \nabla H_I^2 &= 2(H_{x1}\nabla H_{x1} + H_{y1}\nabla H_{y1} + H_{z1}\nabla H_{z1}) \\ &+ 2(H_{x2}\nabla H_{x2} + H_{y2}\nabla H_{y2} + H_{z1}\nabla H_{z2}) \\ &+ \text{terms of angular frequency } 2\omega. \end{aligned} \tag{136}$$

In applying this expression $\nabla H_I^2$ will be obtained electrically; hence the AC component can be filtered out and only the DC component will be retained, which is denoted by G. The effect of this is to remove the terms of angular frequency $2\omega$ from Equation 136, leaving $$G = (\nabla H_I^2)\,\mathrm{DC} = \nabla H_1^2 + \nabla H_2^2 \tag{137}$$

where the subscript DC indicates the DC component, and where $$\begin{aligned} \nabla H_1^2 &= 2(H_{x1}\nabla H_{x1} + H_{y1}\nabla H_{y1} + H_{z1}\nabla H_{z1}) \\ &= 2\left[l_x\left(H_{x1}\frac{\delta H_{x1}}{\delta y} + H_{y1}\frac{\delta H_{y1}}{\delta x} + H_{z1}\frac{\delta H_{z1}}{\delta x}\right)\right. \\ &+ l_y\left(H_{x1}\frac{\delta H_{x1}}{\delta y} + H_{y1}\frac{\delta H_{61}}{\delta y} + H_{z1}\frac{\delta H_{z1}}{\delta y}\right) \\ &\left.+ l_z\left(H_{x1}\frac{\delta H_{x1}}{\delta z} + H_{y1}\frac{\delta H_{y1}}{\delta z} + H_{z1}\frac{\delta H_{z1}}{\delta z}\right)\right]; \end{aligned} \tag{138}$$

$$\nabla H_2^2 = 2\left[l_x\left(H_{x2}\frac{\delta H_{x2}}{\delta x} + H_{y2}\frac{\delta H_{y2}}{\delta x} + H_{z1}\frac{\delta H_{z2}}{\delta x}\right)\right.$$

-continued $$+ l_y\left(H_{x2}\frac{\delta H_{x2}}{\delta y} + H_{y2}\frac{\delta H_{y2}}{\delta y} + H_{z2}\frac{\delta H_{z2}}{\delta y}\right)$$

$$+ l_z\left(H_{x2}\frac{\delta H_{x2}}{\delta z} + H_{y2}\frac{\delta H_{y2}}{\delta z} + H_{z2}\frac{\delta H_{z1}}{\delta z}\right)\Bigg] .$$

It is evident from Equation 147 that the vector G that is obtained with both $\vec{m}_1$ and $j\vec{m}_2$ acting is the sum of the vectors that would be obtained with $\vec{m}_1$ and $j\vec{m}_2$ acting separately. Since both of these can be obtained from Equation 132 by deleting cos $(2\omega t + 2\alpha)$, it follows that they both lie within 14°2′ of the direction toward the (complex) dipole; hence the same is true of the sum G, as can easily be shown by an argument similar to that used in connection with FIG. 13. The fact that the magnetic field is caused by an alternating dipole of the most general type — a complex dipole with two axes — hence causes no difficulty whatsoever. The direction of the vector G can in all cases be taken as the guiding direction of the missile, and can never be more than 14°2′ off target.

If the axis of the missile is not tangent to a gradient curve, the direction of the angular velocity vector that is required to get the missile on course is given by $$\Omega = l_z \times G = \begin{vmatrix} l_x & l_y & l_z \\ 0 & 0 & 1 \\ G_x & G_y & G_z \end{vmatrix} = - l_x G_y + l_y G_x \tag{139}$$

where $G_x$, $G_y$, and $G_z$ are the components of $G$. The required error signals are hence proportional to $(-G_y)$ and $G_x$, respectively.

In order to obtain these quantities using data which are available in the missile during flight, note that $$\nabla H_I^2 = \nabla(H_{xI}^2 + H_{yI}^2 + H_{zI}^2) = 2\,(H_{xI}\nabla H_{xI} + H_{yI}\nabla H_{yI} + H_{ZI}\nabla H_{zI}) \tag{140}$$

where the subscript $I$ indicates instantaneous values. It follows that $$G_x = \text{DC component of } 2\left(H_{xI}\frac{\delta H_{xI}}{\delta x} + H_{yI}\frac{\delta H_{yI}}{\delta x} + H_{zI}\frac{\delta H_{zI}}{\delta x}\right), \tag{141}$$

$$G_y = \text{DC component of } 2\left(H_{xI}\frac{\delta H_{xI}}{\delta y} + H_{yI}\frac{\delta H_{yI}}{\delta y} + H_{zI}\frac{\delta H_{zI}}{\delta y}\right).$$

Note that these expressions do not contain derivatives with respect to $z$, which fact removes the necessity for a pair of sensors to be placed along the missile axis.[2]≠[2]If desirable from the standpoint of computer design, $G_x$ and $G_y$ may be written in the form $$G_x = \text{DC component of } \frac{\delta}{\delta x}\,(H_{xI}^2 + H_{yI}^2 + H_{zI}^2)$$

$$G_y = \text{DC component of } \frac{\delta}{\delta y}\,(H_{xI}^2 + H_{yI}^2 + H_{zI}^2) \tag{141}$$

instead of Equation 141.

These error signals vary inversely as $r^7$; hence the $r$ dependence is the same as that of the error signals (Equation 101). As before the $r$ dependence can be reduced by dividing the error signals by the DC component of $(H_{xI}^2 + H_{yI}^2 + H_{zI}^2)$, in which case the resulting quotients vary inversely as $r$.

In order to investigate the order of magnitude of the available error signals, it may be desirable to calculate these signals for the case of a given dipole. For the dipole (Equation 138), which has an axis, but which should nevertheless be adequate for this purpose, $$G = -\frac{3m_0^2}{8\pi^2 r^7}\,[1_r(1 + 3\cos^2\theta) + 1_\theta \sin\theta\cos\theta]\,, \tag{142}$$

which was obtained by deleting cos $(2\omega t + 2\alpha)$ from Equation 132. $G_x$ and $G_y$ are the components of this vector along the $x$ and $y$ axes, respectively; also, from Equation 139 that $$\sqrt{G_x^2 + G_x^2} = |G| \sin \widehat{l_z G}. \tag{143}$$

Here $\widehat{l_z G}$ is the angle between the vector G and the missile axis. Equation 143 is sufficient in itself to indicate whether or not the available error signals are adequate, it being unnecessary to determine $G_x$ and $G_y$.

DETERMINATION OF H AND ITS SPACE DERIVATIVES DESPITE FIELD DISTORTION BY METALS AND FERROMAGNETIC MATERIAL

The method for locating a dipole that was described in the first section requires a knowledge of the components of H, and of the derivatives of these components with respect to $x$, $y$, and $z$, as is evident from Equation 10. Similarly, from Equations 88 and 101 the first of the two guidance schemes that were described above requires a knowledge of the components of H and their derivatives with respect to $z$. Finally, the second of the two guidance schemes requires a knowledge of these components and their derivatives with respect to $x$ and $y$, as is evident in Equation 141. In all of these cases, there is the problem of determining the free space values of the components of H and certain or all of their derivatives with respect to $x$, $y$, and $z$ at a point in a space — an airplane or missile — despite the fact that this vehicle contains metal and ferromagnetic material. The ferromagnetic material distorts the magnetic field directly, whereas the metals cause distortion through the action of the currents induced in them. Since the induced currents are in general not in phase with the MMF's which produce them, the resulting distorting field does more than produce a simple change of shape in the main field. For example, the field due to an alternating dipole with an axis does not change shape during the course of a cycle; however, because of phase differences the distorting field due to eddy currents when superimposed on the main field gives a resultant field which does change shape during the course of a cycle.

In all cases, the directional derivative of any H component may be obtained by taking the difference between the values of that component that are given by two sensors whose positions differ as much as possible along the desired direction. Accordingly, first consider the problem of determining the H components alone. Let the +z direction be toward the front of the missile (or airplane), as indicated in FIG. 3 and let the $x$ and $y$ directions be toward the left and upward, respectively. The $xz$ and $yz$ planes are thus approximately parallel to the guiding surfaces of the vehicle, namely the wings and tail, or the two sets of wings.

Consider a sensor consisting of three loops whose axes are parallel to the $x$, $y$, and $z$ axes, respectively, and placed at a point where it is desired to measure H — the front of a missile, for example. Were it not for the presence of ferromagnetic material and metal carrying eddy currents, these loops would be ideally located for measuring $H_x$, $H_y$, and $H_z$; however, these quantities apply to the field at the point with no missile (or airplane) present.

Compensation for distortion can be achieved by suitable orientation of the three loops comprising each sensor. This would reduce the amount of undesired flux linking any loop.

Instead of altering the positions of the loops, it would be possible to place pieces of ferromagnetic material so that no undesired flux links any loop. This is equivalent to distorting the field so that the positions of the loops are all right as they stand. Since, because of skin effect, an electric conductor acts to a considerable extent like a magnetic insulator, nonferrous metals can also be placed deliberately to produce desired distortion of the magnetic field.

At the low frequencies under consideration, ferromagnetic material can be used effectively with no great problems arising due to skin effect. Suppose, therefore, that instead of three mutually orthogonal loops three mutually orthogonal slender cylinders, or cores, of ferromagnetic material are used, — each with a coil of wire around its center. The cores could be composed of laminated steel, could be a bundle of iron wires, or could be composed of permalloy, or some material that has a high permeability at a low flux densities. The effect of the cores would be to reduce the required size of the coils, concentrate the magnetic flux where it is wanted, and weaken the magnetic field in the vicinity, with a corresponding reduction in strength of the eddy currents produced nearby. If desired, linear combinations of the three coil voltages could be obtained by placing in series with the coil on each core small coils placed on the other two cores.

What is claimed is:

1. A method of detecting and determining the direction to a low frequency electromagnetic field with respect to the line-of-sight of a body having a body axis comprising positioning at least two sensors for sensing low frequency electromagnetic fields at spaced points in a body;

deriving magnetic field intensity H from at least one of said at least two sensors;

deriving the gradient of the magnetic field intensity $\delta H/\delta r$ from said at least two sensors;

the gradient of the magnetic field intensity being obtained by taking the difference of the measurements of the magnetic field intensity from said at least two sensors separated by the distance between said at least two sensors;

determining the angular difference between the body axis and the line-of-sight to the source which is radiating the electromagnetic low frequency field radiating source based on H and $\delta H$.

2. The method as set forth in claim 1 comprising;

positioning two sets of sensors at mutually spaced points on said body.

3. The method as set forth in claim 1 wherein;

one set of sensors is positioned on said body; and the deviation in direction between H and $\delta H/\delta z$ is determined.

4. The method of claim 2 wherein the angular difference between body axis and line-of-sight to the source which is radiating the electromagnetic low frequency fields radiating source is derived in terms of $\delta H/\delta x$, $\delta H/\delta y$ and $\delta H/\delta z$.

* * * * *